US007644671B2

(12) United States Patent
Smith et al.

(10) Patent No.: US 7,644,671 B2
(45) Date of Patent: Jan. 12, 2010

(54) METHOD AND SYSTEM OF MANUFACTURING A MATTRESS AND COMPONENTS THEREOF

(75) Inventors: Dustin W. Smith, Carthage, MO (US); Kyle W. McClintock, Jasper, MO (US); Nathaniel T. Harris, Oronogo, MO (US); Steven Marcangelo, Londonderry, NH (US)

(73) Assignee: L&P Property Management Company, South Gate, CA (US)

( * ) Notice: Subject to any disclaimer, the term of this patent is extended or adjusted under 35 U.S.C. 154(b) by 463 days.

(21) Appl. No.: 11/735,613

(22) Filed: Apr. 16, 2007

(65) Prior Publication Data

US 2008/0201859 A1 Aug. 28, 2008

Related U.S. Application Data

(60) Provisional application No. 60/904,006, filed on Feb. 28, 2007.

(51) Int. Cl.
*D05B 11/00* (2006.01)
*D05B 13/00* (2006.01)

(52) U.S. Cl. ..... 112/475.08

(58) Field of Classification Search ..... 112/2.1, 112/475.08, 152, 153, 147; 29/91.1, 91; 5/717, 739

See application file for complete search history.

(56) References Cited

U.S. PATENT DOCUMENTS

| | | | | |
|---|---|---|---|---|
| 2,083,555 | A * | 6/1937 | Bowersox | 5/717 |
| 5,529,004 | A | 6/1996 | Porter et al. | |
| 5,586,511 | A * | 12/1996 | Porter et al. | 112/2.1 |
| 5,782,190 | A | 7/1998 | Porter et al. | |
| 6,574,815 | B2 | 6/2003 | Freeman et al. | |
| 6,804,849 | B2 * | 10/2004 | Van Patten | 5/737 |
| 6,834,603 | B1 | 12/2004 | Price et al. | |
| 6,874,215 | B2 * | 4/2005 | Flippin | 29/91.1 |
| 6,889,622 | B2 | 5/2005 | Marcangelo | |
| 6,994,043 | B1 | 2/2006 | Price | |
| 7,021,227 | B2 | 4/2006 | Marcangelo | |
| 7,100,525 | B1 | 9/2006 | Price et al. | |
| 2002/0166175 | A1 * | 11/2002 | An | 5/717 |
| 2004/0129189 | A1 * | 7/2004 | Oxley et al. | 112/2.1 |
| 2005/0204979 | A1 * | 9/2005 | Marcangelo | 112/475.08 |

* cited by examiner

*Primary Examiner*—Ismael Izaguirre
(74) *Attorney, Agent, or Firm*—Wood, Herron & Evans, LLP

(57) ABSTRACT

A system (10) for manufacturing a mattress (300) comprises multiple modules or stations (12, 132, 188, 200) used to sew together multiple components into a casing (252). A spring or other core (270) is inserted into the casing (252) before a top (274) is secured to the casing (252) to complete the mattress (300). Two or more flanges (261, 266) may be incorporated into the casing (252) for securing the core (270) inside the casing (252), The system (10) provides an operator flexibility to manufacture different types of mattress with minimal changes.

27 Claims, 20 Drawing Sheets

METHOD AND SYSTEM OF MANUFACTURING A MATTRESS AND COMPONENTS THEREOF

CROSS-REFERENCE TO RELATED APPLICATIONS

This application claims the filing benefit of U.S. Provisional Patent Application Ser. No. 60/904,006 filed Feb. 28, 2007, the disclosure of which is fully incorporated herein by reference in its entirety.

TECHNICAL FIELD OF THE INVENTION

This invention relates generally to bedding or seating products and, more particularly, to bedding mattresses.

BACKGROUND OF THE INVENTION

The sewing of various components of a mattress together to form a finished product presents several sewing challenges. One such challenge is the sewing of the components at their respective corners. For example, pillow-top mattresses are constructed to appear as though a comforter or pillow has been placed on a conventional mattress to provide a more luxurious and comfortable appearance. The pillow-top is connected to the upper decking of the mattress by an intermediate gusset of folded material. Several different techniques are known to sew the edge of the pillow-top corners to corresponding corners of gusset so that the resulting sewn corners have a consistent and pleasing appearance. However, many of those techniques require various manual operations, and therefore, incorporating the gusset into pillow-top mattresses normally makes them more expensive to manufacture than conventional mattresses.

It is known to miter the gusset to form the gusset around a corner. With one system, the operator cuts an extended length of previously formed gusset material at measured locations where the corners of the cover are expected to be; and the mitered corner is formed on the gusset material before it is attached to the panel. However, due to the nature and construction of the mattress cover material and of the gusset material, often the gussets and panels shrink or change shape at different rates if left to sit, thus somewhat altering the location of the pre-mitered corner on the gusset material with respect to the corner on the mattress panel. This change occurs more frequently when the gusset is manufactured well in advance of the date of assembly of the mattress cover. Since the mitered corners on the gusset are not aligned precisely with the corners of the mattress cover panel, an accommodation has to be made by the operator at the time the gusset is attached to the mattress cover panel, such as by gathering the material or stretching where necessary to properly position the mitered corner. This adjustment results in extra operator time, as well as the possibility that the mitered corner is not properly positioned, or that the corner exhibits an uneven or undesired appearance. Even where the operator is able to properly position the mitered corner, the required stretching or gathering of the material produces a mattress cover which does not have the desired look and which night not be acceptable to all purchasers.

With another known system, a single machine is provided for making the gusset and for attaching the flange material. This machine folds the gusset, stitches it together in its folded condition, and secures the flange material to the gusset. The finished gusset is then cut into lengths and bound to a mattress panel. In conjunction with that operation, a mitering station is provided closely adjacent the binding machine. When it is desired to miter a corner of the gusset, as the operator approaches a corner of the mattress cover panel, the binding machine is stopped, and the operator measures exactly the distance from that point to the corner of the panel. An equivalent distance is marked on the gusset material. The operator then pulls that part of the gusset material over to the closely adjacent mitering station. The gusset material is first folded transversely at that point. Next, two stitches are applied by a sewing machine to the gusset from the folded edge inwardly. Each stitch is at a 45 degree angle with respect to the folded edge of the gusset, so that the stitches form a 90 degree angle with respect to each other. The sewing machine preferably is preprogrammed to stitch precisely the desired number of stitches needed for the miter. All the operator must do is wait until the stitches have completed, rotate the gusset material through 90 degrees and start the machine again. Thereafter, the triangular section defined by the stitches and the folded edge is cut out of the gusset material either automatically, or manually, and the gusset material is removed from the mitering station. While more automated, the above operation still requires numerous steps by the operator to form a corner during the process of attaching the gusset to another piece.

U.S. Pat. No. 6,834,603 discloses a system used to attach a gusset of an upper deck of a mattress like the one shown in U.S. Pat. No. 6,574,815. However, in such a mattress the ruffled gusset must be attached to the border panel, the pillow-top and lastly to the upper deck of the mattress. These multiple sewing steps are time consuming, increase the chance of operator error and increase the cost of the resulting product.

Therefore, there is a need for an improved process for reliably manufacturing a pillow-top mattress and the apparatus to implement the process.

SUMMARY OF THE INVENTION

The invention which fulfills this need comprises a system for manufacturing a seating or bedding product and methods of using the system. In one embodiment, the system may be used to manufacture a one-sided pillow-top mattress. Such a mattress has a casing or bucket inside which is secured a spring core or its equivalent using flange material. The casing is covered with a cover sewn onto what is known in the industry as a gusset located around the perimeter of the mattress, the gusset being ruffled at the corners of the mattress. The casing further comprises a bottom panel and a side panel known in the industry as a border. The bottom panel is common made of a non-skid type of material but may be made of any material. Such a mattress may be manufactured more quickly and efficiently than prior art pillow-top mattresses because a mattress manufactured accordance with the present invention does not require the gusset to be sewn to an inner panel in multiple locations. The novel ruffled pillow-top mattress of this invention eliminates the need for an inner panel or upper deck, attaches the flange material to the gusset for support provided by the inner panel in prior art mattresses and ruffles the flange material.

In accordance with one aspect of this invention, the system comprises multiple sewing stations or modules, each one of which has at least one sewing machine or head. The first sewing station comprises a first and second sewing table, each supported by a base having legs. Each sewing table has its own sewing machine. At the upstream end of the first sewing station, a roll support is adapted to support a roll of border material and another roll support is adapted to support a roll of gusset material. Each roll support is supported by a frame upstream of the first sewing table. However, the roll supports may be attached to any component or portion of the first module or alternatively, be stand alone components.

The first sewing station further comprises a plurality of guide bars used to guide the webs of border and gusset material to the first sewing machine. Some of the guide bars have adjustable side guides which enable the module or stewing station to be used with different widths of gusset and/or border material. The guides are used to align common edges of the webs of gusset and border material prior to such webs being sewn together along a first seam, the unticked surfaces of such webs contacting each other. The gusset web is located above the border web, the tick side of the border web facing down and the tick side of the gusset web facing up. Kevlar thread may be used in any of the sewing machines of the system. A tape holder is secured to the first sewing table and is adapted to hold a roll of sewing tape which is folded by a binder into a generally U-shape and placed around the aligned edges of the webs of border and gusset material prior to the webs being sewn together with the first seam by the first sewing machine. Thus, the first seam has a tape edge which is visible around the perimeter of the mattress when the manufacturing process is over.

First and second pullers, each driven by a servo motor, are secured to the first sewing table. Each puller comprises a pair of rotatable wheels which grip the webs of material and pull them to their desired location at a desired speed. The first puller is located upstream of the first sewing machine and the second puller is located downstream of the first sewing machine.

The first sewing station further comprises a first opener secured to the first sewing table which comprises a metal plate used to separate or open the webs of border and gusset material joined with the first seam. The first opener makes the webs of border and gusset material generally coplanar which exposes the other edge of the gusset material and enables a first web of flange material to be secured to this exposed edge of the web of gusset material at the second sewing table of the first sewing station or module. In this position, the webs of gusset and border material may be considered in an open position or condition.

After being opened, the combined and opened webs of border and gusset material are pulled over an idle roller secured to the upstream portion of the second sewing table by a third puller attached to the second sewing table downstream of the second sewing machine or head. This opened web combination is then pulled past a second sewing machine located on the second sewing table which makes a second seam. A holder for a roll of flange material is secured to the second sewing table, as is a flange folder. The flange folder changes the direction of a first web of flange material as it comes off the roll so the first web of flange material flows or moves with the combined webs of border and gusset material.

The second sewing machine sews the unrolled first web of flange material to the exposed edge of the web of gusset material to complete a border assembly web. In this condition, the first web of flange material lays on top of the web of gusset material, contacting the unticked side of the web of gusset material. This combination of webs is considered a border assembly web for purposes of this document. This border assembly web is rolled up in this condition. A third puller attached to the second sewing table pulls the border assembly web past the second sewing machine, over an idle roller at the downstream end of the second sewing table, over an end station downstream of the second sewing table and onto a motorized mechanism for rolling up the border assembly web.

The motorized mechanism for rolling up the border assembly web comprises motorized storage holder comprising a rotatable roller driven by a motor. Once a roll of border assembly web has been formed and the roll holder is full, the border assembly web is cut and the roll moved to the second sewing station or module of the system.

The second sewing station or module comprises a roll holder mounted on a frame upstream of a sewing table. This non-motorized roll holder is adapted to receive and retain the roll of the web of border assembly from the first sewing station. A pair of guides are incorporated into the station to guide the unrolled border assembly web into a puller driven by a motor which is secured to the frame upstream of the sewing table. The puller pulls the web over an idle roller secured to the upstream edge of the sewing table and past a marker which is used to mark the unticked surface or side of the web of border material. The puller pulls the unrolled web past a sewing machine which sews the first web of flange material to the web of gusset material along a third seam spaced inwardly from aligned edges of the webs of gusset and flange material. In this manner, the first web of flange material is further joined to the web of gusset material.

This third sewing machine of the system (the only one at the second station) has a ruffler which ruffles the first web of flange material and the web of gusset material at predetermined locations based on input received from an encoded mounted on the upstream side of the sewing table. This encoder additionally functions to send a signal to a marker which marks the unticked side of the web of border material at predetermined locations based on the length of material which has passed the encoder. A cutter assembly is located at the end of this second sewing station or module for cutting the ruffled and marked border assembly web to create a border assembly piece of a predetermined length. The cutter assembly includes a blade protected with a safety cage.

The third sewing station or module of the system comprises a sewing table on which is located another sewing machine, the fourth sewing machine of the system. This sewing machine is used to create a border assembly loop by sewing the ends of the border assembly piece together. A plurality of thread holders are mounted on a mounting assembly secured to the sewing table. A mitering table is also mounted to the sewing table for use in alternative embodiments, such as when a continental appearance is desired on the bottom surface of a mattress.

One method of manufacturing a casing for use in the manufacture of a bedding or seating product using the system of this invention comprises first sewing the web of border material to the web of gusset material along a first seam using the first sewing machine of the first sewing station. A piece of tape may be incorporated in this first seam to create a tape edge.

The second sewing machine of the first module is used to sew a first web of flange material to the web of gusset material along a second seam, the first web of flange material overlaying the web of gusset material while the second seam is being sewn. The combined webs of border and gusset material in combination with the first web of flange material make up an unfinished or unruffled border assembly web which is rolled up at the end of the first module or station of the system, the ticked sides of the webs of flange and border material facing outwardly in one embodiment. However, the assembly may be rolled up in any desired configuration with either side facing out.

At the second sewing station or module, a third sewing machine is used to sew the first web of flange material and the web of gusset material along a longitudinally extending third seam spaced inwardly from the second seam. This third sewing machine is also used to ruffle the webs of flange and gusset material at predetermined positions to complete the border assembly web.

At the second sewing station or module, the border assembly web, and more particularly, the unticked side of the web of border material is marked at predetermined locations to aid in sewing a bottom panel of the casing to the border assembly loop at the fourth and last station or module of the system. An encoder secured to the sewing table at the second sewing station is used to help the ruffler operate at the correct locations (at the corners of the casing) and ruffle the webs of flange and gusset material at predetermined locations. After being marked and ruffled with the third sewing machine, the ruffled border assembly web is cut to a predetermined length to create a marked and ruffled border assembly piece. The encoder sends a signal to a controller which operates a cutter assembly for cutting the ruffled and marked border assembly web at the correct predetermined location to create a piece of the proper length for a select size mattress, for example a queen size mattress.

At the third sewing station or module, the ends of the border assembly piece are sewn together to create a border assembly loop. Before sewing begins, an operator aligns marks on the border assembly piece so that the correct size casing will be made.

At the fourth sewing station or module, a bottom panel is sewn to the border assembly loop. At this last station or module, a second web of flange material may be inserted between the border assembly loop and the bottom panel to create a lower flange inside the mattress casing. Tape is introduced and formed to surround the aligned edges of the bottom panel, the second web of flange material and the border assembly loop prior to a seam being sewn. The result is an exposed tape edge around the perimeter of the mattress at the lower edge of the mattress casing and resultant mattress.

After the bottom panel has been secured to the border assembly loop of the casing, a spring, foam or equivalent core is inserted inside the interior of the casing and covered with one or more layers of padding such as foam or fiber pads. Lastly, a top piece is secured to the upper exposed edge of the casing and more particularly, the upper edge of the gusset to complete a one-sided pillow-top mattress.

In summary, the present invention provides a method of manufacturing a casing for use in the manufacture of a bedding or seating product, comprising the following steps: 1) sewing a web of border material to a web of gusset material along a first seam; 2) sewing a first web of flange material to the web of gusset material along a second seam, the first web of flange material overlaying the web of gusset material while the second seam is being sewn; 3) sewing the first web of flange material and the web of gusset material along a longitudinally extending third seam spaced inwardly from the second seam; 4) ruffling the webs of flange and gusset material at predetermined positions to complete a border assembly web; 5) cutting the border assembly web to a predetermined length to create a border assembly piece; 6) sewing the ends of the border assembly piece together to create a border assembly loop; and 7) sewing a bottom panel to the border assembly loop.

Another summary of the method of manufacturing a casing for use in the manufacture of a mattress is as follows: 1) at a first sewing station: sewing a first web of border material to a web of gusset material along a first seam using a first sewing head and sewing a first web of flange material to the web of gusset material along a second seam using a second sewing head downstream of the first sewing head, the web of flange material overlaying the web of gusset material; 2) at a second sewing station remote from the first sewing station: sewing the webs of flange and gusset material along a longitudinally extending third seam spaced inwardly from the second seam using a third sewing head; ruffling the webs of flange and gusset material at predetermined positions to complete a border assembly web and cutting the border assembly web to a predetermined length to create a border assembly piece; 3) at a third sewing station remote from the first and second sewing stations: sewing the ends of the border assembly piece together along a fourth seam to create a border assembly loop using a fourth sewing head; and 4) at a fourth sewing station remote from the first and second sewing stations: sewing a bottom panel to the border assembly loop along a fifth seam using a fifth sewing head.

The present invention includes a method of manufacturing a bedding or seating product comprising the following steps: 1) sewing a web of border material to a web of gusset material proximate aligned edges of the webs; 2) sewing a first web of flange material to the web of gusset material along an edge of the gusset material oppose the edge of the gusset material joined to the border material to create a three piece web, the web of flange material overlaying the web of gusset material; 3) sewing the webs of flange and gusset material along a longitudinally extending seam spaced inwardly from the sewn edges of the webs of flange and gusset material, the sewing including ruffling the webs of flange and gusset material at predetermined positions to complete a border assembly web; 4) cutting the border assembly web to a predetermined length to create a border assembly piece; 5) sewing the ends of the border assembly piece together to create a border assembly loop; 6) sewing a bottom panel to the border assembly loop to complete a casing; 7) inserting a spring core into the casing; 8) laying padding materials over the spring core; and 9) sewing a top panel to an outer edge of the gusset material of the casing.

According to an another aspect of the invention, a box top mattress may by manufactured using the system. The first sewing station further comprises a roll holder adapted to receive and retain a roll of box top border material. A web of box top border is pulled off the roll and attached at the second sewing table by the second sewing machine to the web of gusset material simultaneously with the first web of flange material. Commonly a web of tape is using for this sewing operation to create a tape edge around the mattress where the box top border meets the upper edge of the gusset with a seam sewn by the second sewing machine. After the web of box top border and first web of flange material are secured to the web of gusset material using the second sewing machine, the web of box top border lays on top of the first web of flange material which lays on top of the web of gusset material. In combination with the web of border material, the assembly comprises a closed or unopened border assembly web. This unopened border assembly web is pulled by a third puller attached to the second sewing machine past a second opener attached to the second sewing table which opens the unopened border assembly web so that the webs of border, gusset and box top material are all generally coplanar. This opened border assembly web including a web of box top material is then rolled up by the motorized storage holder in an open condition or position as described above.

One advantage of this system is that it provides flexibility to quickly repair one or more components of the system without shutting down the entire sewing operation. One or more of the modules may be replaced with another like module and the system continue to operate.

These and other objects and advantages of this invention will be more readily apparent from the following drawings, in which:

DETAILED DESCRIPTION OF THE DRAWINGS

Figure 1:
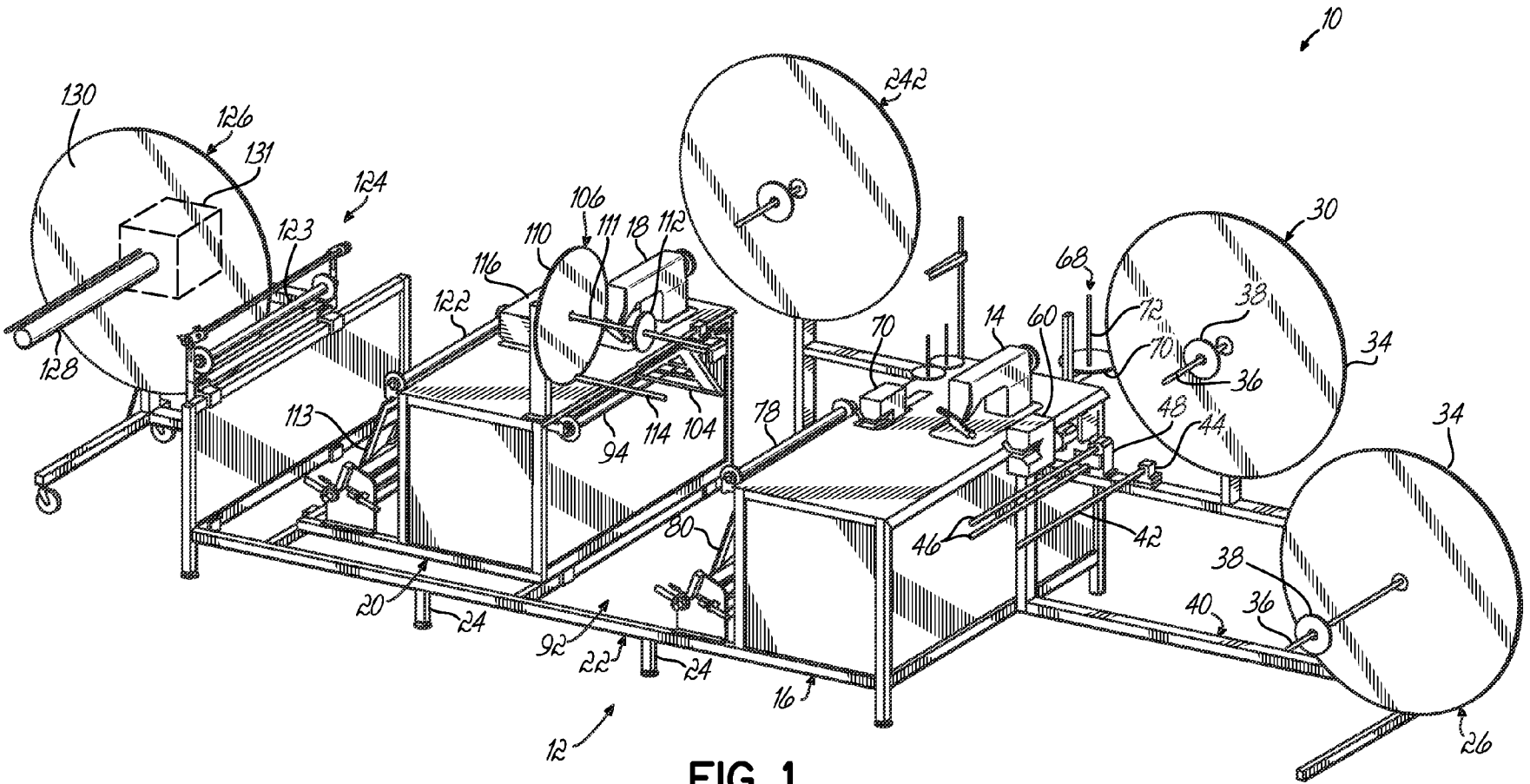
FIG. 1 is a perspective view of a first sewing station in accordance with this invention.

With reference to the figures, there is illustrated a system 10 used to manufacture different types of mattresses. FIG. 1 illustrates a first sewing station or module 12 which has two sewing machines, a first sewing machine or head 14 located at a first sewing table 16 and a second sewing machine or head 18 located at a second sewing table 20 downstream of the first sewing table. The first and second sewing tables 16, 20 are supported by a base 22 having legs 24.

Figure 5:
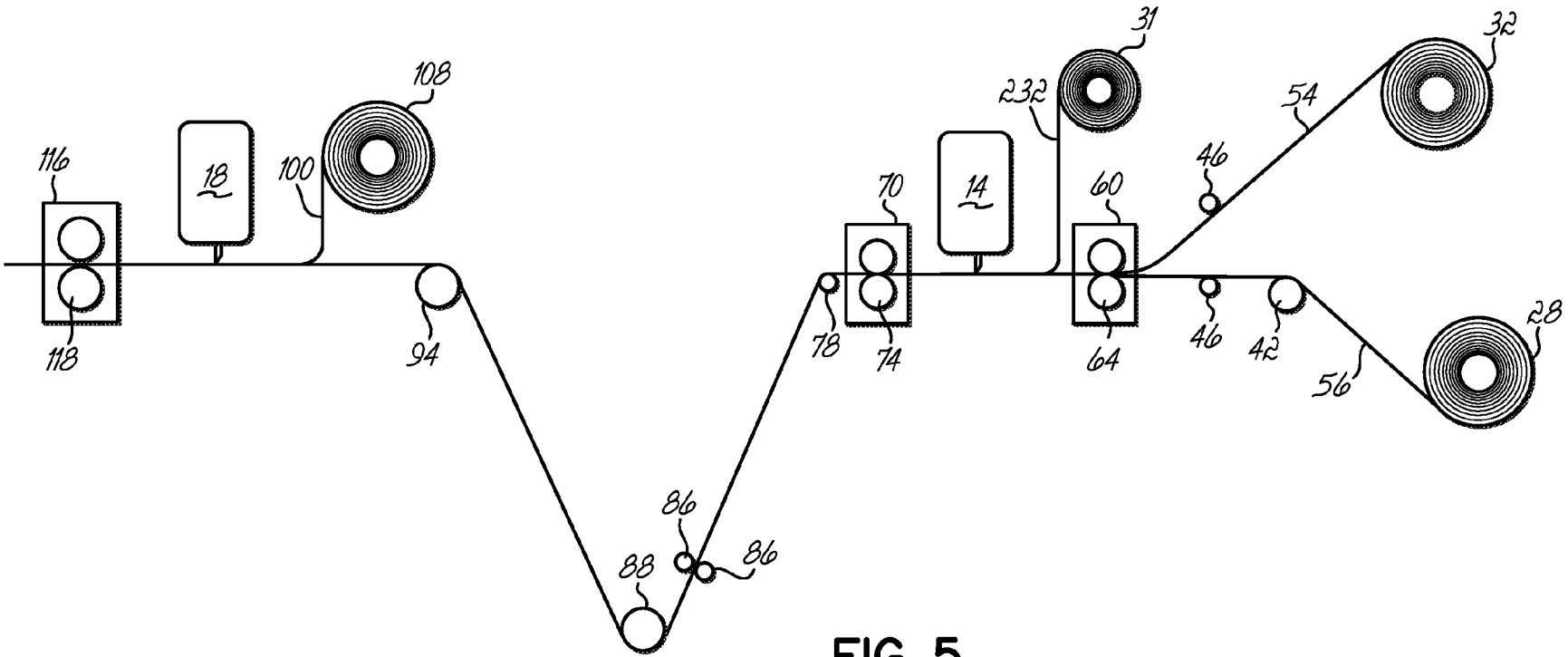
FIG. 5 is an schematic view of the sewing station of FIG. 1 showing the rolls and flow of materials.

As shown in FIG. 1, moving generally from upstream to downstream, the first sewing station 12 comprises a roll support 26 adapted to receive and retain a roll of border material 28 (see FIG. 5) and a roll support 30 adapted to receive and retain a roll of gusset material 32, each roll support 26, 30 comprising a circular stationary disk 34 and a rod 36 extending outwardly therefrom along with an adjustable lock 38 slidable on the rod 36. Roll supports 26, 30 are attached to a support frame 40. Although one configuration of roll support and one configuration of support frame are illustrated, any other configuration or design of roll support or support frame may be used.

Figure 6:
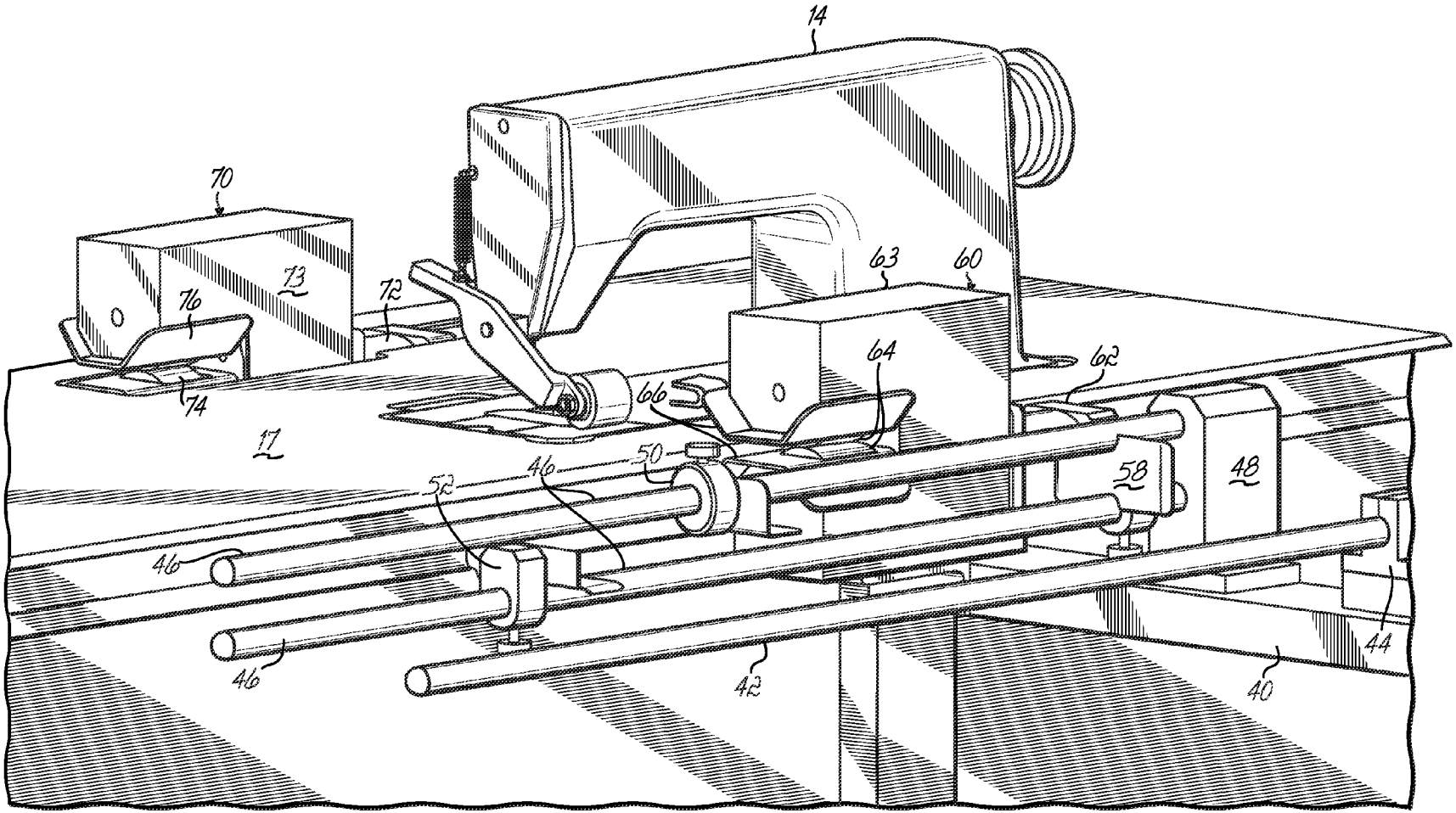
FIG. 6 is an enlarged perspective view of a portion of the first sewing station of FIG. 1.

As best shown in FIG. 6, a first guide bar 42 is secured to and extends outwardly from block 44 adjustably secured to support frame 40. Similarly, a pair of guide bars 46 extend outwardly and secured to a block 48 which is adjustably secured to the frame 40 like block 44. The upper guide bar 46 has an adjustable guide 50 secured thereto which may be moved along the upper guide bar 46 according to the width of the web of gusset material 54 coming off roll 32. Similarly, lower guide bar 46 has an adjustable guide 52 which may be adjusted, along the lower guide bar 46 depending upon the width of the web of border material 56 coming off roll 28. See FIG. 5. A stop 58 is sandwiched between the guide bars 46 to help align edges of the webs border and gusset material.

As best illustrated in FIG. 6, immediately downstream of the guide bars 46 is a first puller 60 driven by a servo motor 62. The puller 60 comprises a pair of rotatable wheels 64 between which the webs of border and gusset material 56, 54 pass. The puller 60 further includes a casing 63 inside which the wheels 64 rotate and a pair of generally U-shaped guides 66 for guiding the webs of border and gusset material 56, 54 to wheels 64. The guides 66 may have openings through which the wheels 64 pass.

As shown in FIG. 6, a first sewing machine or head 14 is immediately downstream of the first puller 60 and sits atop an upper surface 17 of first table 16. Although one configuration of sewing machine 14 is illustrated, any conventional sewing machine or head may be used.

Referring to FIG. 1, a tape holder 68 is secured to the first table 16. This tape holder 68 comprises a disk 70 and a rod 72 extending upwardly from the disk 70 on which a roll of tape 31 may be inserted and used during the operation of the first sewing machine 16. See FIG. 5. The first sewing machine 14 is used to join the web of border material 56 to the web of gusset material 54 with a first seam which includes a tape edge produced by including a web of tape 232 in the first seam. See FIGS. 5 and 19.

As shown in FIGS. 1 and 6, immediately downstream of the first sewing machine 14 is a second puller 70 driven by a servo motor 72. The second puller 70, like the first puller 60, comprises a pair of rotatable wheels 74 between which the webs of border and gusset material 56, 54, joined by first seam 234 pass. See FIG. 19. The puller 70 further includes a casing 73 inside which the wheels 74 rotate and a pair of generally U-shaped guides 76. The guides 76 have openings through which the wheels 74 pass. As shown in FIGS. 1 and 6, the first puller 60 is located upstream of the first sewing machine 14 and the second puller 70 is immediately downstream of the first sewing machine 14. Both the first and second pullers 60 are associated with the first sewing table 16. Although one configuration of puller is illustrated, any conventional puller may be used.

Figure 7:
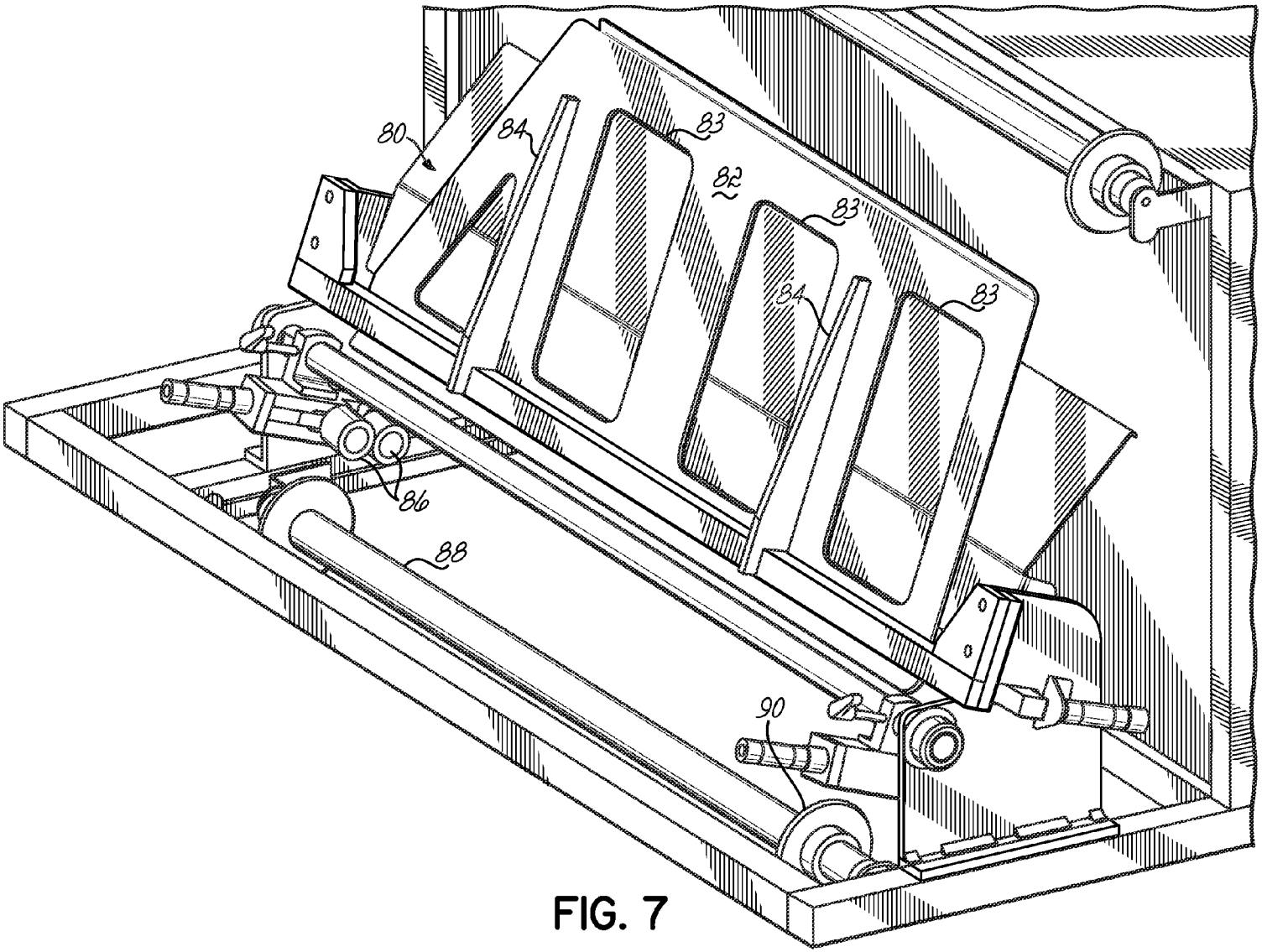
FIG. 7 is an enlarged perspective view of another portion of the first sewing station of FIG. 1.
Figure 9:
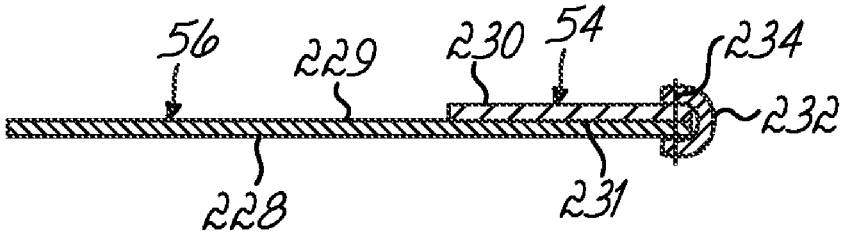
FIG. 9 is a side elevational view of the webs of border and gusset material sewn together by a first seam.
Figure 9A:
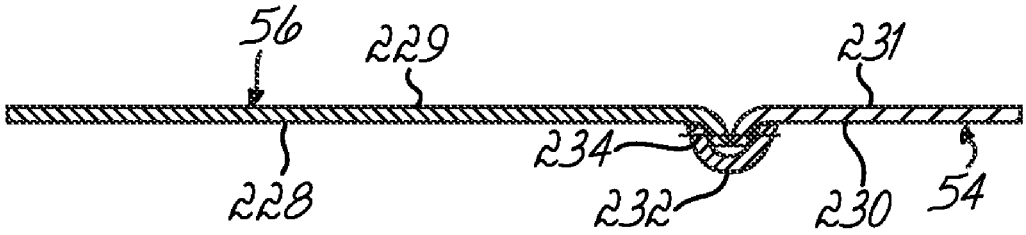
FIG. 9A is a side elevational view of the combined webs of border and gusset material sewn in an open position.

Referring to FIGS. 1 and 7, an idle roller 78 is attached to the first sewing table 16 on the downstream side thereof. The combined, sewn together, webs of gusset and border material 54, 56 pass over this idle roller 78 and downwardly along the downstream side of the first sewing table 16 to an opener 80, which is shown in detail in FIG. 7. This opener 80 is operatively coupled to the base 22. As shown in FIG. 7, the opener 80 comprises a metal plate 82 having generally rectangular openings 83 therethrough and a pair of fins 84 extending upwardly or outwardly from the metal plate 82. The purpose of the opener 80 is to separate and open the combined webs of gusset and border material 54, 56 so that a first web of flange material may be sewn or joined to the web of gusset material 54 as described below. The combined webs of gusset and border material 54, 56 enter the opener 80 oriented in a closed overlapped position as shown in FIG. 9 and exit the opener 80 in an open position as shown in FIG. 9A. Once open, the opened webs of gusset and border material 54, 56 pass through pinch rollers 86 and under idle roller 88 between adjustable side guides 90 which are adjustable along idle roller 88.

Figure 8:
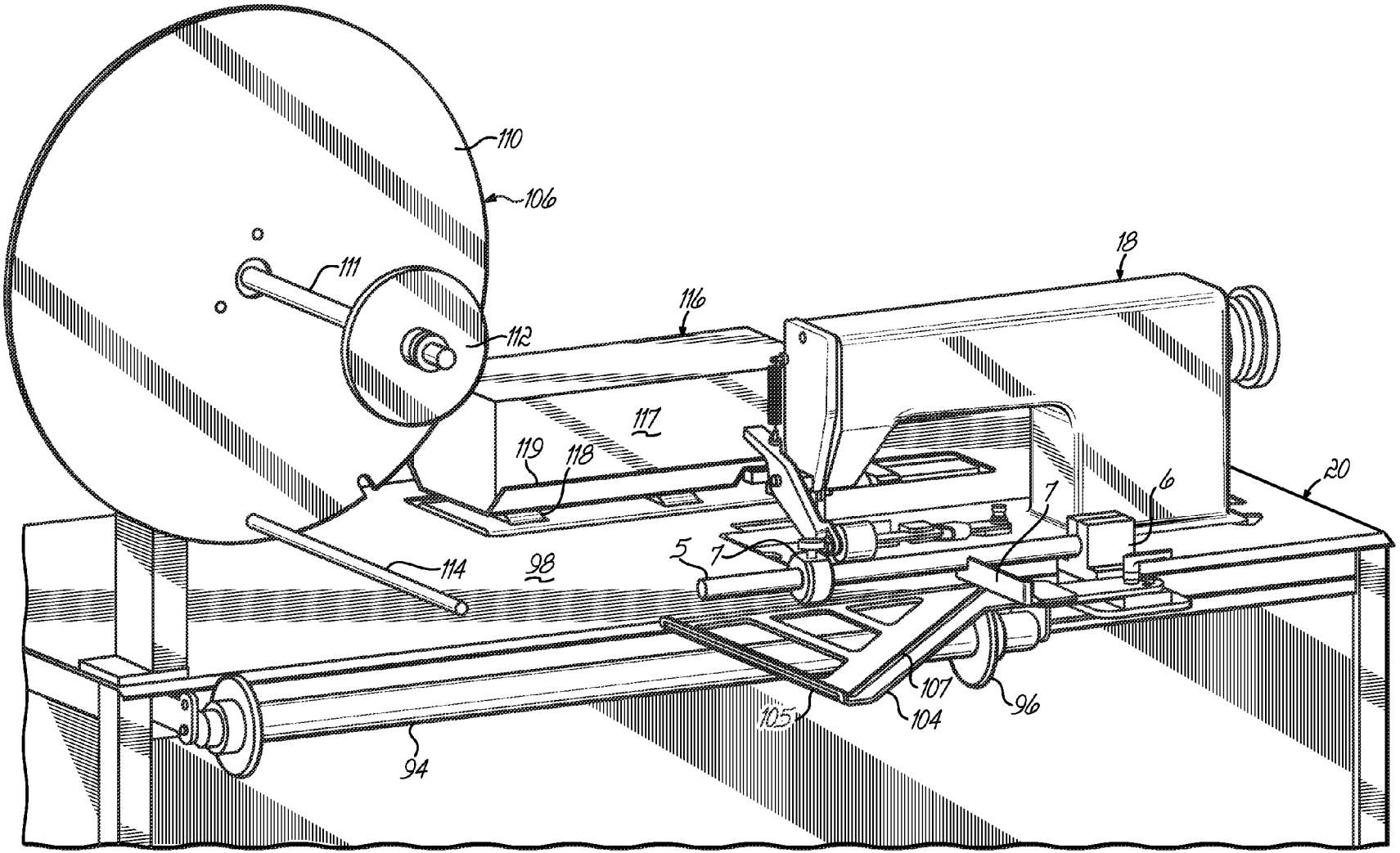
FIG. 8 is an enlarged perspective view of a portion of the first sewing station of FIG. 1.
Figure 9B:
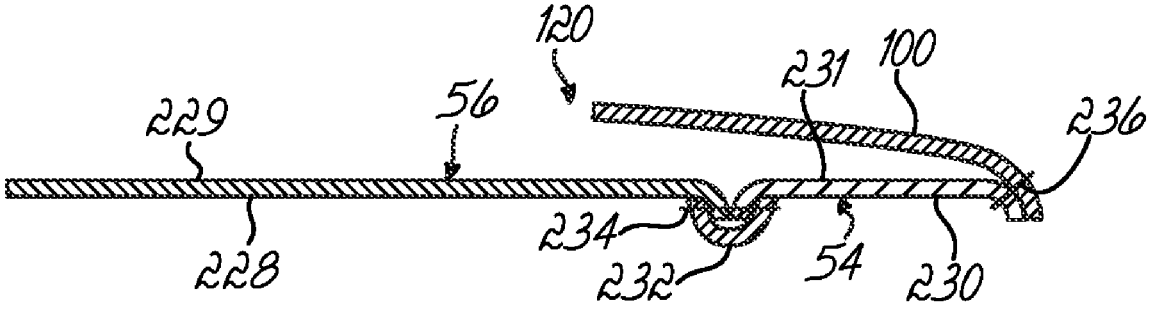
FIG. 9B is a side elevational view of a first web of flange material joined to the web of gusset material by a second seam.
Figure 19:
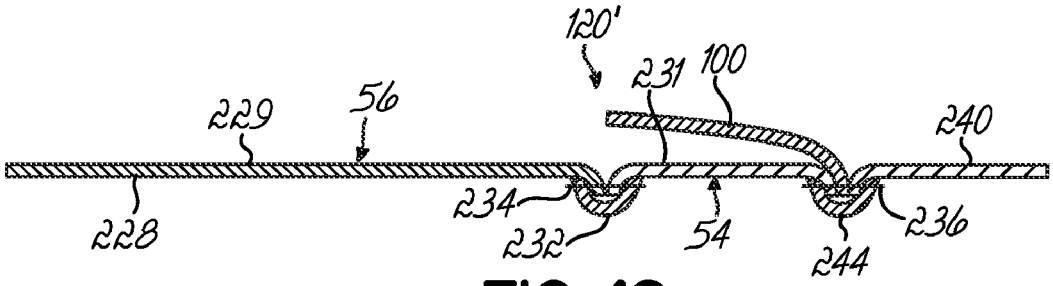
FIG. 19 is a side elevational view of an alternative embodiment of opened border assembly having a box top border prior to being marked and ruffled at the second sewing station.

As shown in FIG. 1, the combined or joined webs of gusset and border material 54, 56 as shown in FIG. 9A, then pass through a gap 92 between the first and second sewing tables 16, 20, and then pass upwardly over idle roller 94 having adjustable side guides 96. The idle roller 94 is secured to the upstream side of second sewing table 20. As shown in FIG. 8, the second sewing table 20 has a generally planar upper surface 98 and a second sewing machine or head 18 mounted thereto. This second sewing machine 18 is used to secure a first or upper web of flange material 100 to the web of gusset material 54 with a second seam 236 as shown in FIG. 9B. This second sewing machine 18 may further be used to secure a web of box top border 102 to the web of gusset material 54 with a tape edge as shown in FIG. 19, as described below.

Figure 8A:
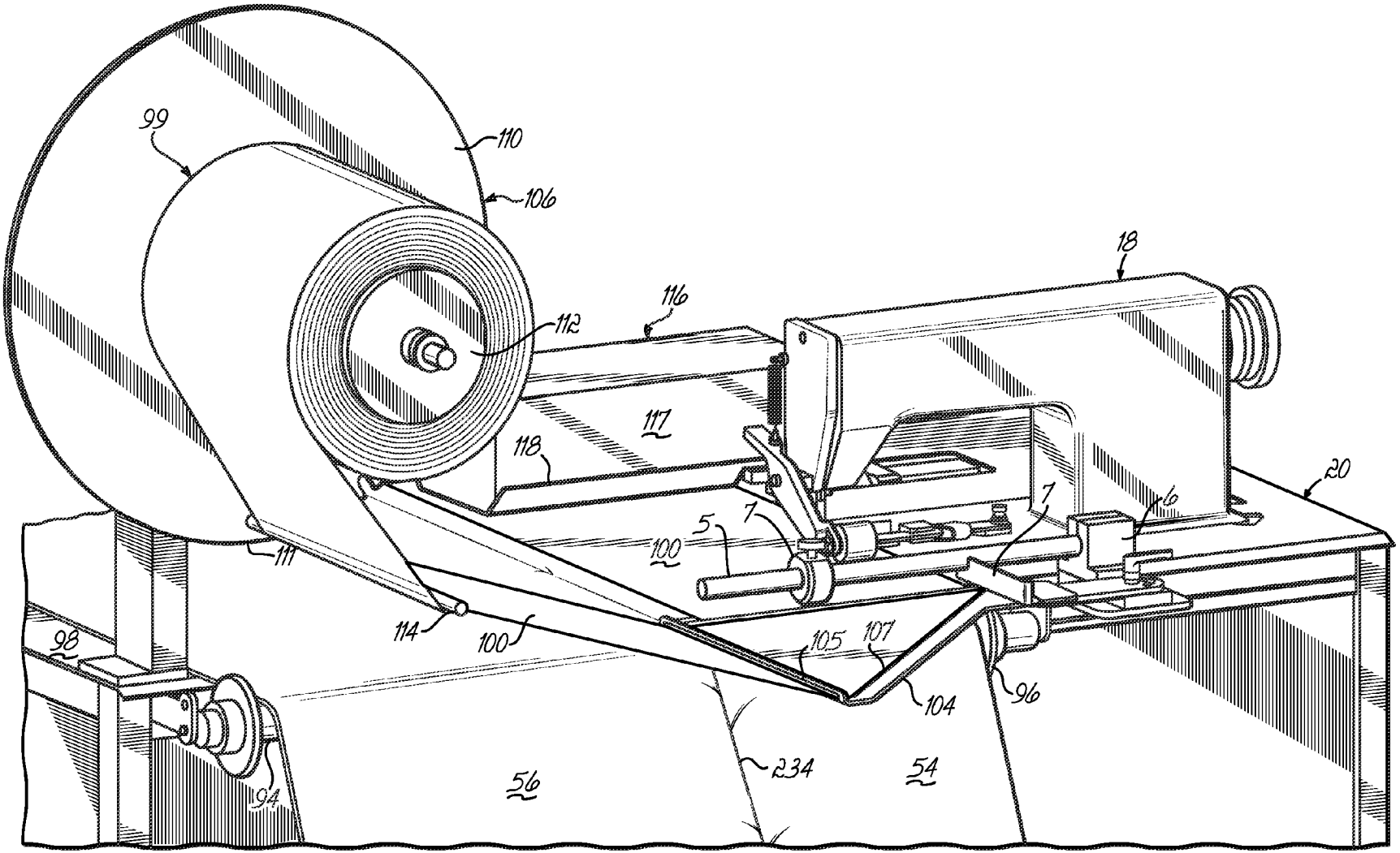
FIG. 8A is an enlarged perspective view like FIG. 8 of a portion of the first sewing station of FIG. 1 showing the first web of flange material being introduced into the second sewing head or machine.

As shown in FIG. 8, a generally triangular flange folder 104, as shown in FIG. 8 is mounted to the second sewing table 20 and used to change the direction of flow of the web of flange material 100. As shown in FIGS. 8 and 8A, a flange holder 106 adapted to retain a roll of flange material 108 is secured to and extends upwardly from the second sewing table 20. The flange holder 106 comprises a stationary disk 110, a holding rod 111, a lock mechanism 112 and a stationary guide 114 extending out from the disk 110.

As shown in FIG. 8, downstream of the second sewing machine 18 is a third puller 116 comprising a pair of rotatable wheels 118 between which the opened border assembly 120 passes. As shown in FIG. 9B, the border assembly 120 comprises the webs of gusset and border material 54, 56 along with the attached first web of flange material 100. The puller 116 further includes a casing 117 inside which the wheels 118 rotate and a pair of generally U-shaped guides 119. The guides 119 have openings through which the wheels 118 pass. Although one configuration of puller is illustrated, any conventional puller may be used. This third puller 116 pulls the border assembly 120 as shown in FIG. 9B over the second sewing table 20 and over an idle roller 122 secured to the second sewing table 20 at the downstream end thereof.

As shown in FIG. 1, downstream of the second sewing machine 18 and third puller 116 is another or second opener 113, like opener 80 shown in detail in FIG. 7. The second opener 113 is secured to the base 22 and is used only when a box top mattress casing is manufactured as described herein. In the manufacture of a casing for a box top mattress like the one shown in FIG. 20, this second opener 113 functions to separate or open a web of box top border material 240 from the web of gusset material 54. See FIG. 19.

Another part or component of the first module 12 used only when sewing a casing for a box top mattress is a guide 5 secured with a bracket 6 or operatively coupled to the second sewing table 20 as shown in FIG. 8. The guide 5 has side guides 7 which may be adjusted along the length of guide 5 to be approximately equal to the width of a web of box top border 240. See FIG. 19.

Figure 17:
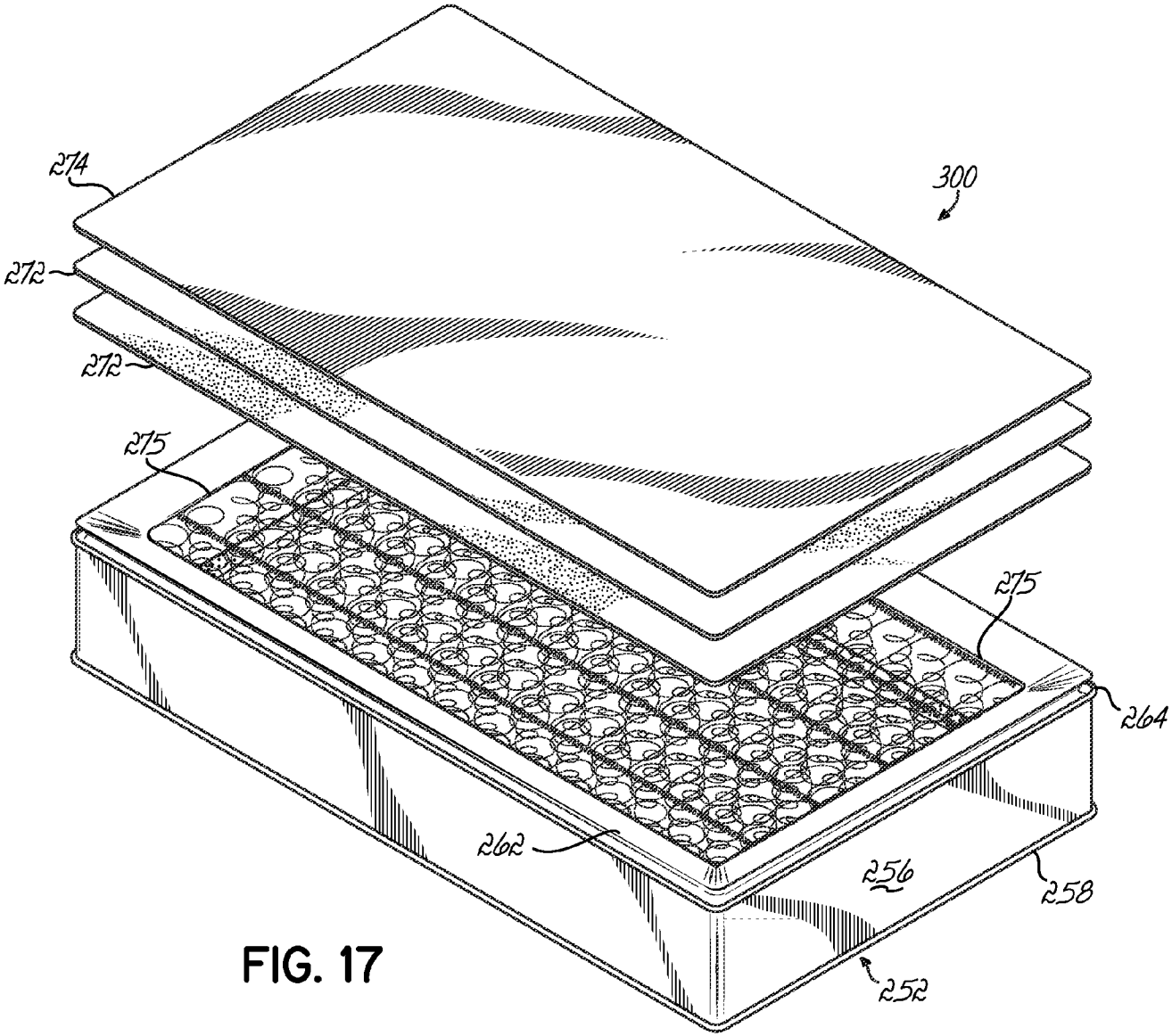
FIG. 17 is an exploded view of a mattress built in accordance with one embodiment of the present invention.

When manufacturing a mattress casing or bucket 252 like the one shown in FIG. 17, the opened border assembly 120 like the one shown in FIG. 9B is pulled over an idle roller 123 of an end station 124 by a motorized storage holder 126 after it exits the third puller 116 shown in FIG. 8. The storage holder 126 comprises a driven roller 128 driven by a motor 131 located behind a disk 130. The disk 130 may be rotatable or stationary. This motorized storage holder 126 is used to wind the opened border assembly 120 into a roll 138 (see FIG. 10) which is then moved to the second module, station or machine 132 of the system 10 shown in FIGS. 2 and 10.

Figure 2:
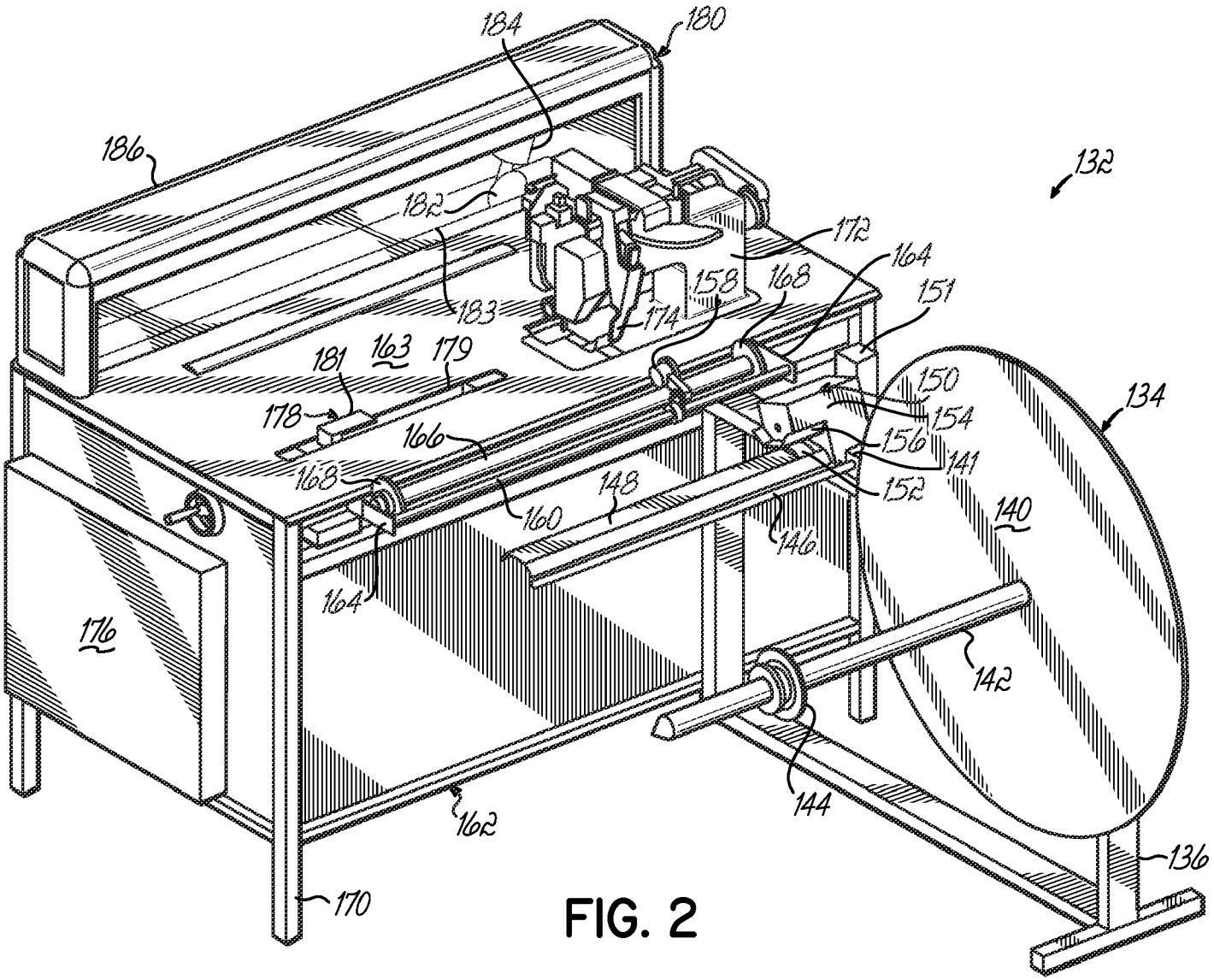
FIG. 2 is a perspective view of a second sewing station in accordance with this invention.

FIG. 2 illustrates the second module or sewing station 132 of the system 10. This second sewing station 132 comprises a roll holder 134 mounted on a frame 136 for holding the roll 138 of border assembly 120 (see FIG. 10) which came from off the motorized storage holder 126 of the first module or sewing station 12 shown in FIG. 1. The non-motorized roll holder 134 comprises a non-rotatable disk 140, a stationary rod 142 extending outwardly from disk 140 and a movable lock 144 movable along stationary rod 142. A stationary guide bar 146 is also secured to and extends outwardly from a block 141 adjustably secured to frame 136. See FIG. 1. Although one configuration or type of roll holder 134 is illustrated, any other roll holder may be used such as a rotatable roll holder, for example.

Another puller 150 is also secured to frame 136. The puller 150 comprises a pair of rotatable wheels 152, a casing 154 and a pair of generally U-shaped guides, a lower guide 148 and an upper guide 156, the lower guide 148 being longer than the upper guide 156. The puller 150 is operated by a motor 151 which may be an AC motor or a servo motor. One of the wheels, the lower wheel 152 passes through an opening in lower guide 148 while the upper wheel passes through an opening in upper guide 156. Puller 150 pulls the rolled up border assembly 120 off the roll 138 as shown in FIG. 10.

Figure 10:
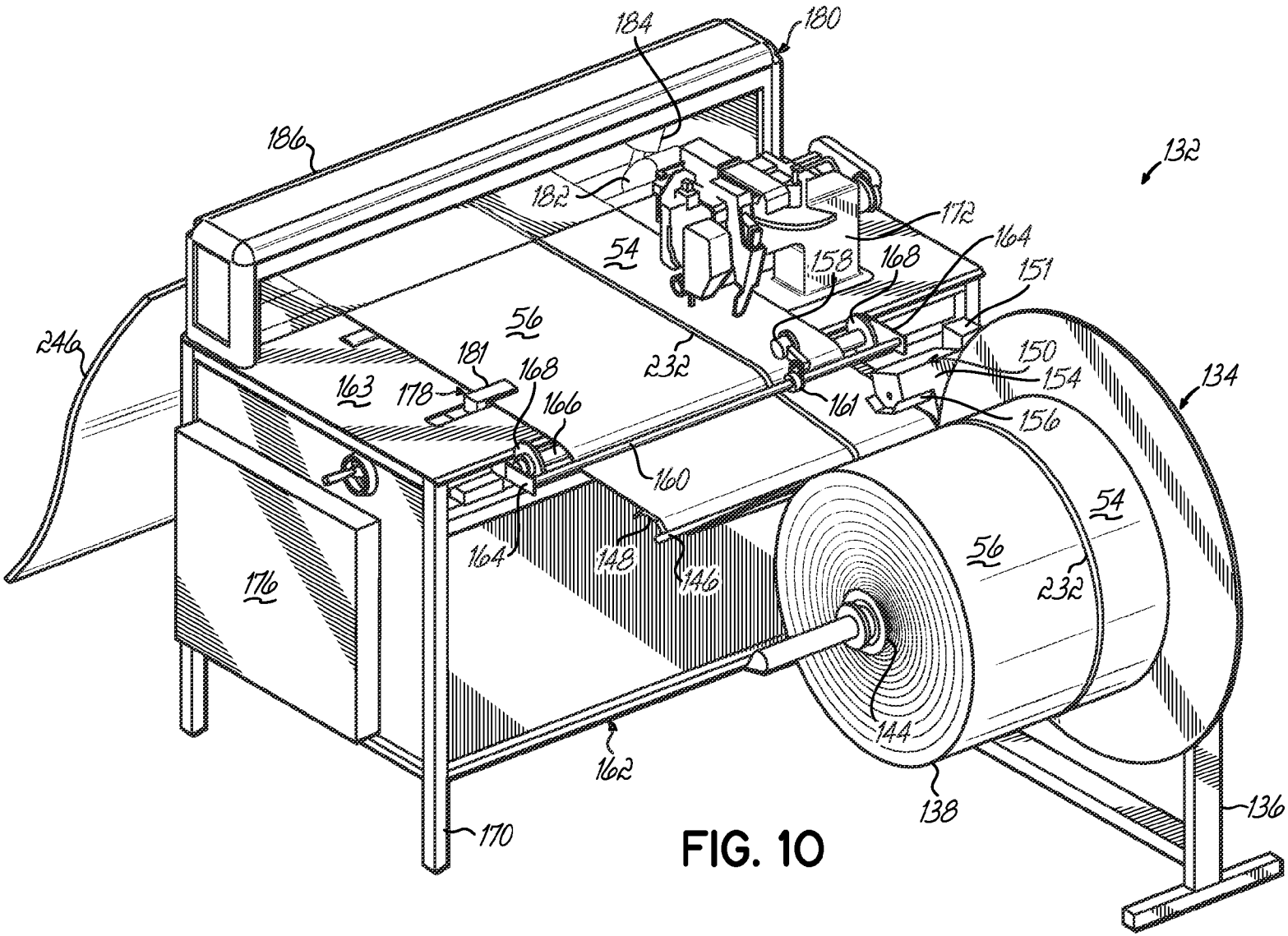
FIG. 10 is a perspective view of the second sewing station of FIG. 2 showing the flow of material.

As shown in FIG. 10, the border assembly 120 is unwound from roll 138 by puller 150 and passes between stationary guides 146, 148. It then travels underneath an encoder 158 adjustably mounted on stationary bar 160 with a bracket 161. See FIGS. 2 and 10. As shown in FIG. 2, bar 160 is secured to a sewing table 162 with brackets 164. Any other device other than a bar may be used to secure an encoder like encoder 158 in a desired location.

FIG. 2 further illustrates a idle roller 166 secured to the sewing table 162 with brackets 164 and having a pair of side guides 168 adjustably secured thereon. As shown in FIG. 10, the border assembly 120 passes over idle roller 166 and under stationary bar 160 before passing underneath encoder 158.

As shown in FIG. 2, the sewing table 162 having an upper surface 163 is supported by legs 170 and has a sewing machine or head 172 mounted thereto. The sewing machine 172 has a ruffler 174 attached thereto. The ruffler 174 may be any conventional ruffler or one disclosed in U.S. Pat. Nos. 6,889,622 and 7,021,227, both of which are incorporated by reference herein. A control panel 176 having a touch pad (not shown) is located on one side of the sewing table 162.

FIG. 2 illustrates a marker 178 operatively coupled to the second sewing station 132. The marker 178 is used to mark the underside of the web of border material 56 at predetermined locations based on data received from the encoder 158. More particularly, the marker 178 comprises two cylinders which move the marker 178 in a groove or opening 179 in the second sewing station 132. As shown in FIGS. 2 and 10, the marker includes an arm 181 which presses down upon the web of border material 56 as the web of border material 56 passes along the upper surface 163 of the sewing table 162. The portion of marker 178 which makes the mark on the web of border material 163 is located underneath the upper surface 163 of the sewing table 162.

Downstream of the marker 178 and sewing machine 172 is a motorized cutter assembly 180 comprising a circular blade 182 and a motor 184. A safety cage 186 protects the operator and others. The circular blade 182 travels inside a groove 183 in the upper surface 163 of the sewing table 162. Although one type of cutter assembly is illustrated and described herein, any other type of cutter assembly may be used with this module or system.

Figure 3:
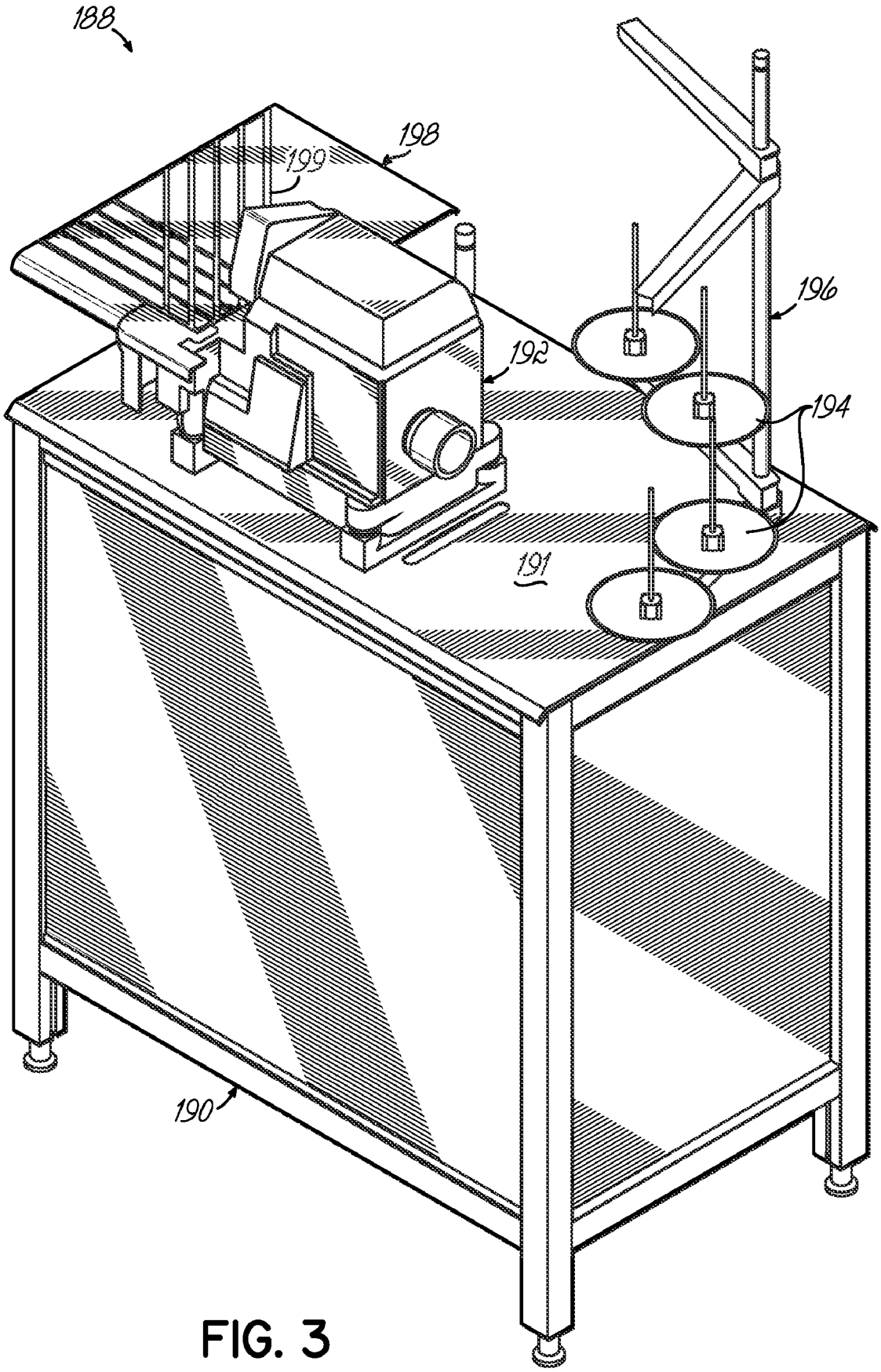
FIG. 3 is a perspective view of a third sewing station in accordance with this invention.
Figure 11:
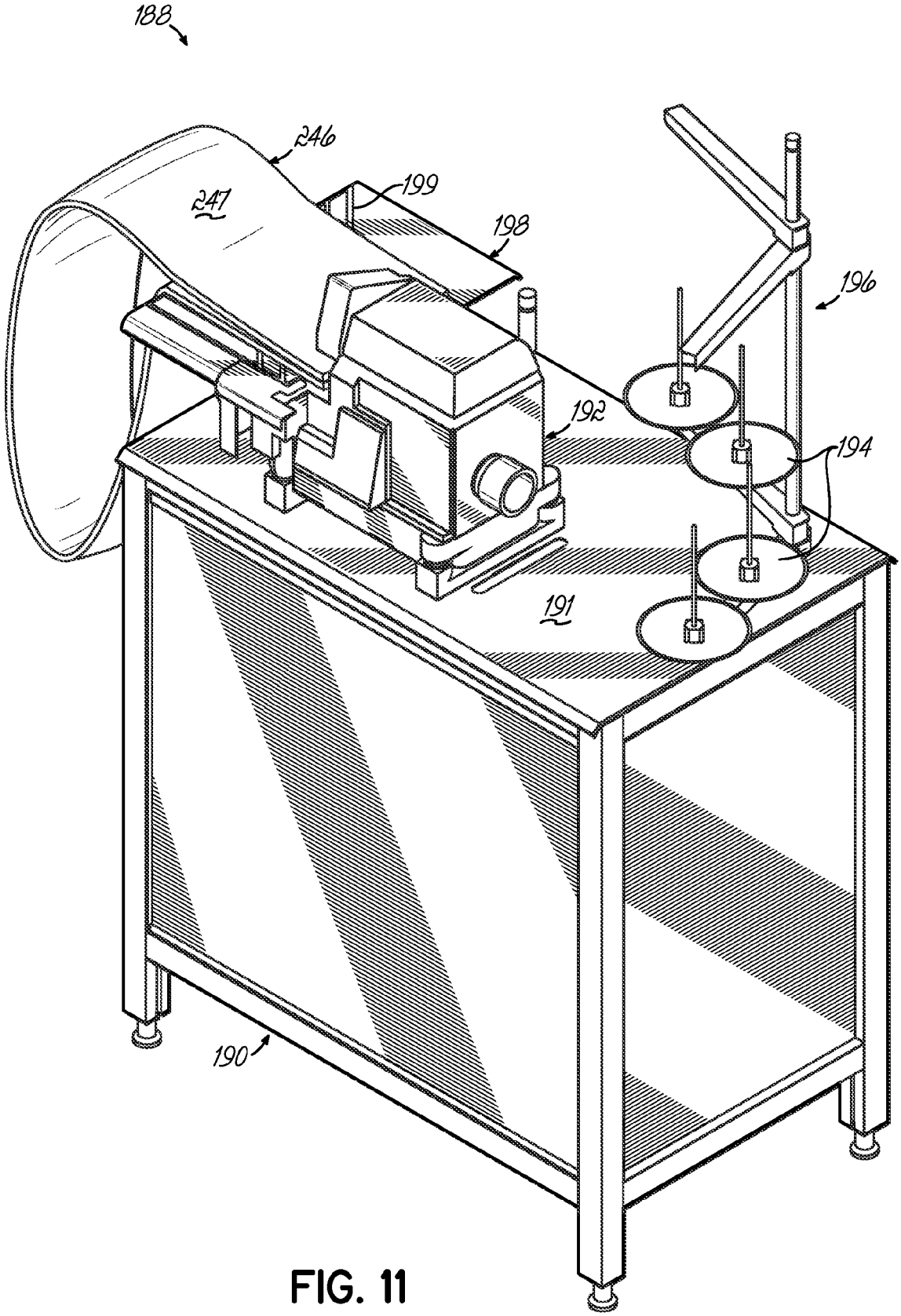
FIG. 11 is a perspective view of the third sewing station of FIG. 3 showing the completion of a border assembly loop.
Figure 13:
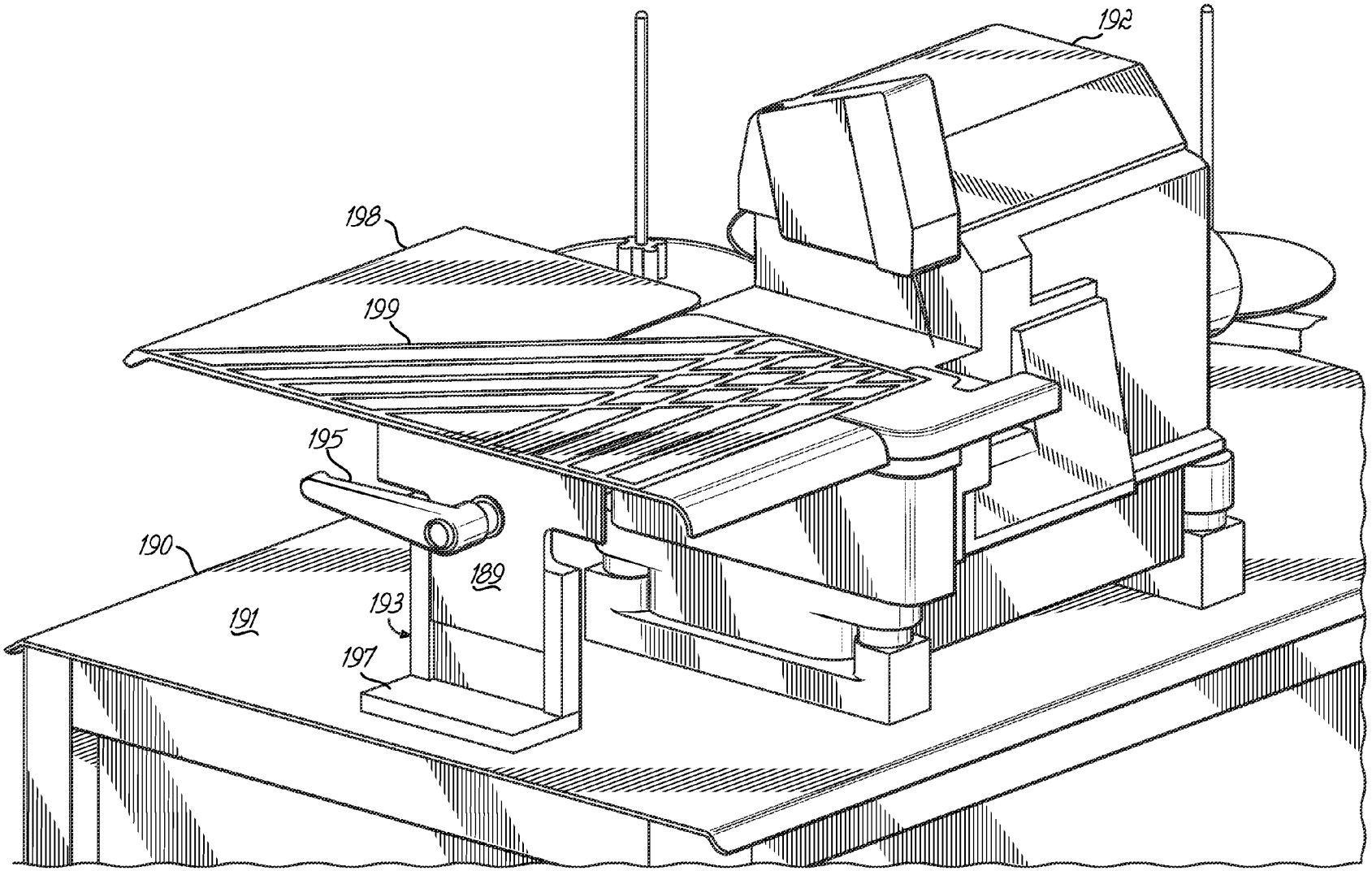
FIG. 13 is an enlarged perspective view of a portion of the third sewing station of FIG. 3.

FIG. 3 illustrates the third module or sewing station 188 of the system 10. This third sewing station 188 comprises another sewing table 190 having an upper surface 191 and a sewing machine 192, this one without a ruffler. A plurality of thread holders 194 mounted on a mounting assembly 196 are used. As shown in FIG. 13, a mitering plate 198 is mounted to the sewing table 190 with an adjustable bracket 193. The mitering plate 198 has a plurality of angled lines 199 on the upper surface thereof used to properly align material when a mitered corner is being made. Adjustable bracket 193 comprises a plate 189 secured to the mitering plate 198 which rides in a holder 197 fixed to the upper surface 191 of the sewing table 190. The adjustable bracket 193 has a handle 195 which is used to allow an operator to adjust the height of the mitering plate 198. Although one type of adjustable bracket is illustrated and described herein, any other type of mounting mechanism may be used to secure the mitering plate 198 to the sewing table 190. Thus, the third sewing station or module 188 may be used to create a border assembly loop 248 as shown in FIG. 11 and to miter the lower corners of the border assembly loop in the event a continental look or appearance is desired for the bottom surface of the mattress.

Figure 4A:
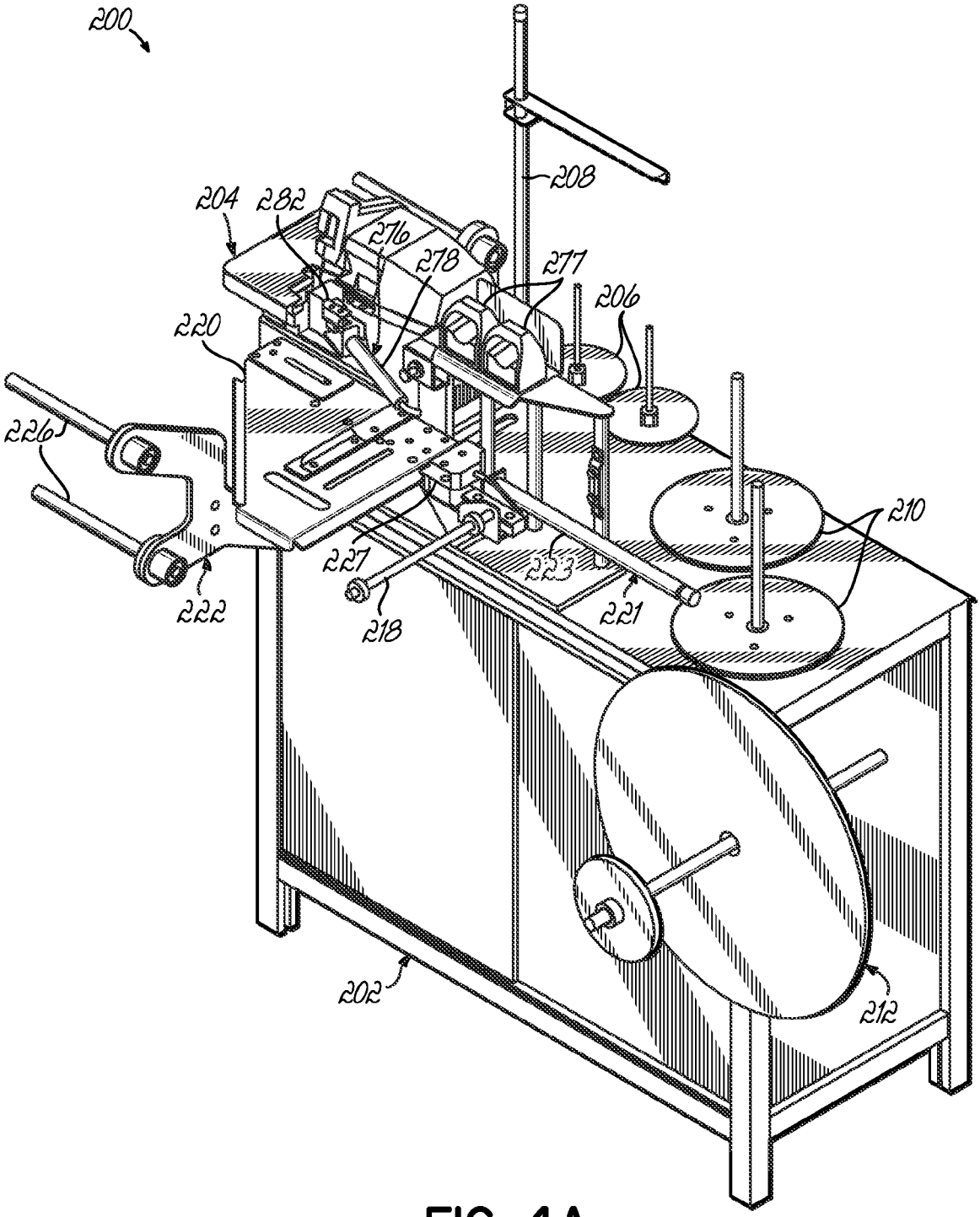
FIG. 4A is a perspective view of a fourth sewing station in accordance with this invention, the flange folder and binder being shown in an retracted position.
Figure 4B:
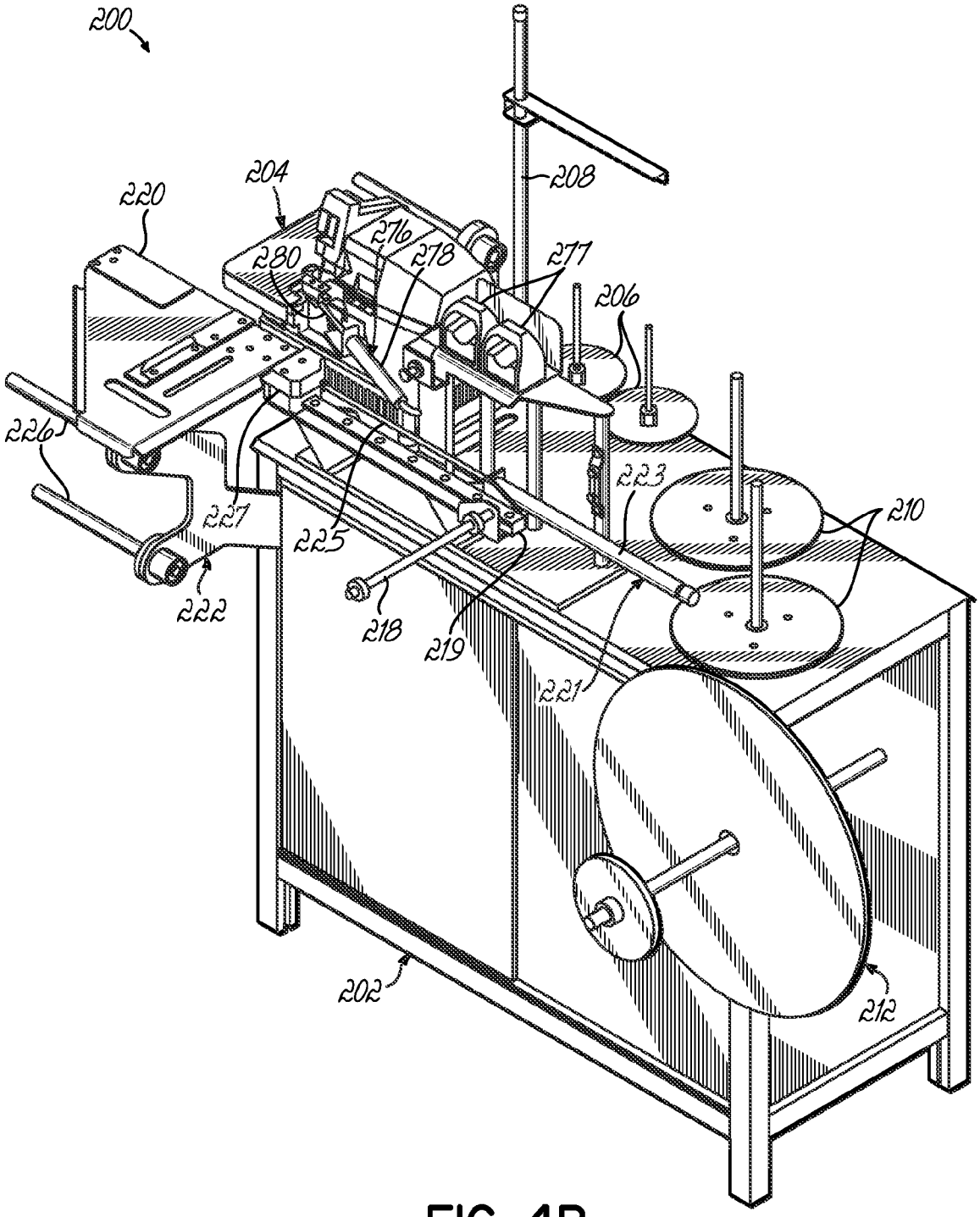
FIG. 4B is a perspective view of the fourth sewing station of FIG. 4A, the flange folder and binder being shown in an extended position.

FIG. 4A illustrates the fourth module or sewing station 200 of the system 10 in a loading position while FIG. 4B illustrates the sewing station 200 in a sewing position. This fourth sewing station 200 comprises another sewing table 202 and sewing machine 204, this one without a ruffler. A plurality of thread holders 206 mounted on a mounting assembly 208 are adapted to receive and retain rolls of thread 207 as shown in FIG. 12.

In addition, a pair of tape holders 210 are secured to the sewing table 202. The tape holders 210 are adapted to receive and retain rolls of tape 209 as shown in FIG. 12. One reason for multiple tape holders 210 is so that different types or colors of tape may be used in sewing machine 204. However, only one roll of tape 209 is used at a time.

Figure 12:
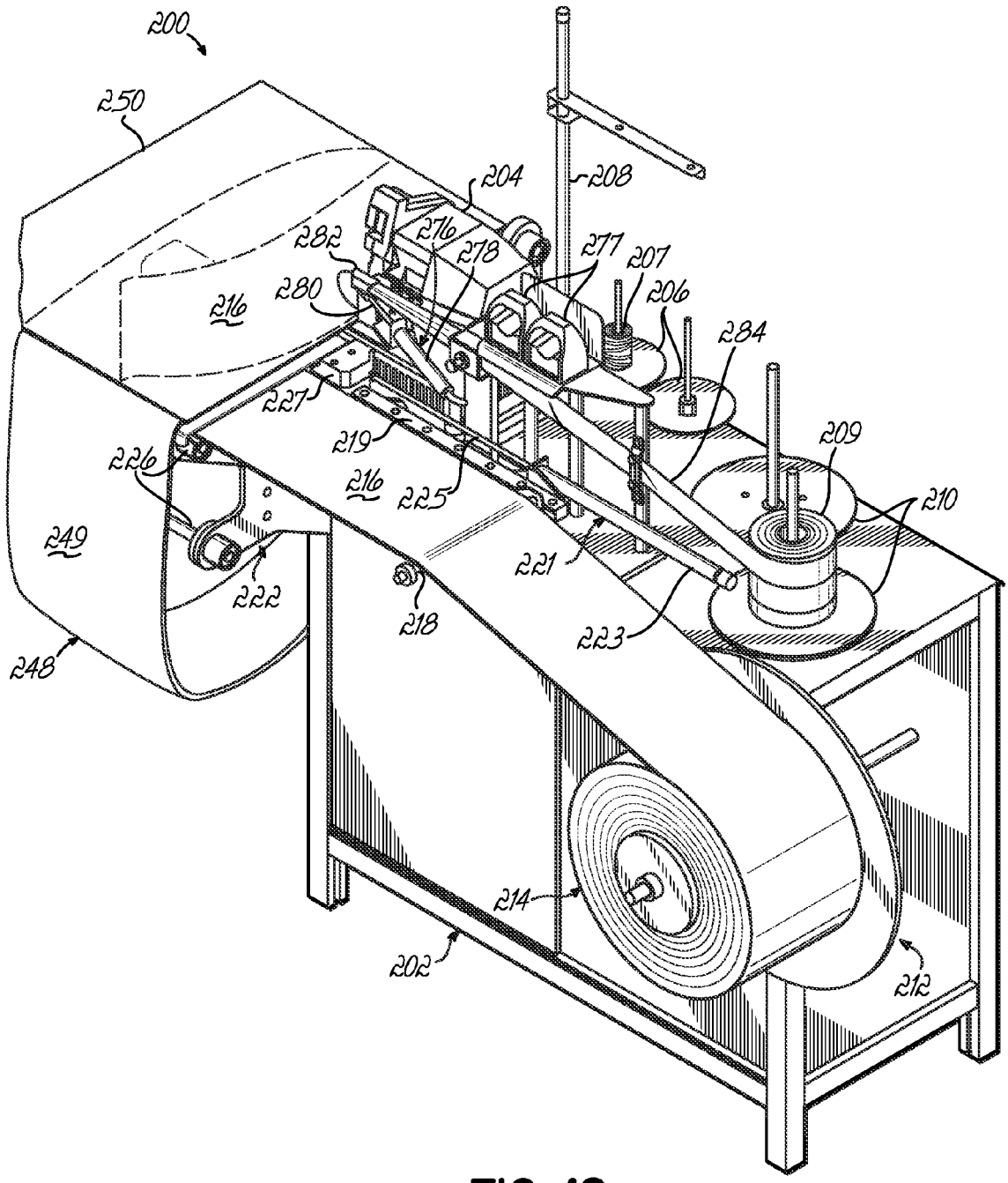
FIG. 12 is a perspective view of the fourth sewing station of FIG. 4 showing sewing a bottom panel to the border assembly loop with a second web of flange material.

As shown in FIG. 12, a roll holder 212 adapted to receive and retain a roll of flange material 214 is mounted to the sewing table 190. As the second web of flange material 216 is unwound from the roll 214, it passes over a bar 218 projecting outwardly from the sewing table 202. As shown in FIG. 12, the second web of flange material 214 is introduced into a flange folder 220 which is like flange folder 104 used at the first sewing station shown in FIG. 1. The fourth sewing station 200 further comprises a loop holder 222 including a central bracket 224 secured to the sewing table 202 and a pair of bars 226 secured to the central bracket 224. The purpose of the loop holder 222 is to hold the border assembly loop 248 as shown in FIG. 12.

The fourth sewing station 200 further comprises a first actuator 221 comprising a cylinder 223 and a rod 225 movable from a retracted position shown in FIG. 4A to an expanded position shown in FIG. 4B. One end of the rod 225 is joined to a bracket 227 joined to flange folder 220. Thus, the actuator 221 is operatively coupled to the flange folder 220 for moving the flange folder 220 from a retracted position shown in FIG. 4A to an extended position shown in FIG. 4B. In so moving, the bracket 227 slides along a guide bar 219, best shown in FIG. 4B. When the flange folder 220 is in its retracted position shown in FIG. 4A, the border assembly loop 248 may be easily and quickly placed on the loop holder 220 without the flange folder 220 interfering. When the operator is ready to sew, the operator activates the first actuator 221 by placing his or her finger in one of the push button assemblies 277 to extend rod 225 and move the flange folder 220 to its extended position shown in FIG. 4B.

The fourth sewing station 200 further comprises a second actuator 276 comprising a cylinder 278 and a rod 280 movable from a retracted position shown in FIG. 4A to an expanded position shown in FIG. 4B. One end of the rod 280 is joined to a U-shaped binder 282 for folding the web of tape 284 coming off roll 209. Thus, the second actuator 276 is operatively coupled to the binder 282 for moving the binder 282 from a retracted position shown in FIG. 4A to an extended position shown in FIG. 4B. When the binder 282 is in its retracted position shown in FIG. 4A, the materials to be sewn may be easily and quickly placed in correct alignment without the binder 282 interfering. When the operator is ready to sew, the operator activates the second actuator 276 by placing his or her finger in one of the push button assemblies 277 to extend rod 280 and move the binder 282 to its extended position shown in FIG. 4B.

In operation, using the system 10, and more particularly, the first sewing station 12 shown in FIGS. 1 and 5-8A, the web of border material 56 is unrolled from roll 28 located on roll holder 26, the ticked surface or side 228 of the border material web 56 being face down and the unticked side 229 facing up. See FIG. 9. Similarly, the web of gusset material 54 is unrolled from roll 32 located on roll holder 30, the ticked surface or side 230 of the gusset material web 54 being face up and the unticked side 231 facing down. See FIG. 9. The edges of the webs of border and gusset material 56, 54, respectively, are aligned, pulled through first puller 60 and surrounded with a web of tape 232 unwound from a roll of tape 31 on roll holder 68. The first sewing machine 14 then sews a first seam 234 through the web of tape 232, web of gusset material 54 and web of border material 56. See FIG. 9.

As shown in FIG. 1, second and third pullers 70, 116 pull the combined webs of gusset and border material 54, 56 as shown in FIG. 9 over idle roller 78 and into opener 80 shown in detail in FIG. 7 which opens the webs of gusset and border material 54, 56 into a generally co-planar orientation shown in FIG. 9A. In this open position or configuration, the ticked sides 228, 230, respectively, of the webs of gusset and border material 54, 56 are facing down. The combined opened webs of gusset and border material 54, 56 as shown in FIG. 9A then pulled by the third puller 116 on the second sewing table 20 through pinch rollers 86 (see FIG. 7) under idle roller 88 in gap 92 and over idle roller 94 secured to the second sewing table 20. See FIG. 5.

As shown in FIG. 8A, the first web of flange material 100 is unwound from a roll 99 on roll holder 106, passed under guide 114 and through an opening 105 in flange folder 104. As shown in FIG. 8A, the first web of flange material 100 is then passed through opening 107 in flange folder 104 before being pulled through the sewing machine 18. As shown in FIG. 9B, the first web of flange material 100 is placed on top of the web of gusset material 54 so it contacts the unticked side 231 of the web of gusset material 54. The first web of flange material 100 is sewn by sewing machine 18 to the exposed edge of the web of gusset material 54 along second seam 236 as shown in FIG. 9B to form a border assembly 120. The third puller 116 then pulls the border assembly 120 as shown in FIG. 9B over idle roller 122 and over idle roller 123 of end station 124. In this open condition shown in FIG. 9B with the first web of flange material 100 overlaying the web of gusset material 54 and more particularly the unticked side 131 of the web of gusset material 54, the unruffled border assembly 120 is rolled up into a roll 138 (see FIG. 10) by motorized storage holder 126 and then transported to the second module or sewing station 132 shown in FIG. 2. The roll 138 is such that the ticked side of the webs of border and gusset material 56, 54 face outwardly.

Referring to FIG. 10, the roll of opened unruffled border assembly 138 is placed on roll holder 134. The web of opened unruffled border assembly is then fed through puller 116, then passes between guide bar 146 and guide 148 before being passed between guide bar 160 and idle roller 166. Encoder 158 registers the linear distance traveled by the web of opened unruffled border assembly. When a preprogrammed distance has passed, the sewing machine 172 makes a ruffle 286 in the overlapped web of gusset material 54 and first web of flange material 100. See FIG. 14. When a preprogrammed distance has passed, the marker 178 makes a mark 288 on the unticked side 229 of the web of border material 56 at the center of each ruffle 288 along with two marks 290 at predetermined locations for use at the next sewing station or module. See FIG.

Figure 14:
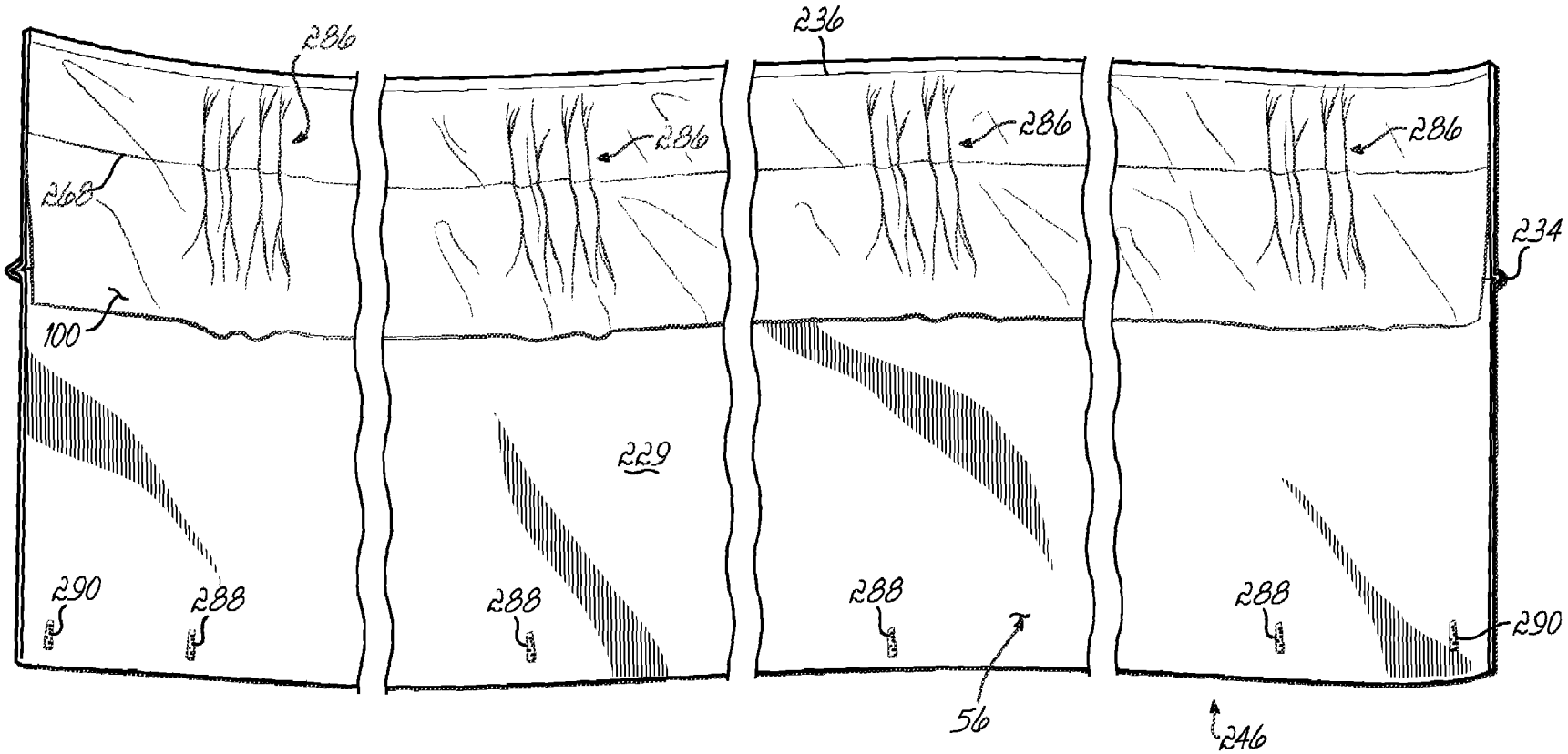
FIG. 14 is a side elevational view of the border assembly piece which comes off the second module or sewing station, showing the marks and ruffles.

14. Once the four corners of the web of opened unruffled border assembly have been marked and ruffled, the ruffled and marked border assembly web 246 as shown in FIG. 14 continues to the cutter assembly 180 where the ruffled and marked border assembly web is cut. The encoder 158 allows the ruffled and marked border assembly web to travel a fixed predetermined linear distance from the needle of sewing machine 172 to blade 182 of the cutter assembly 180. The operator then pushes a button which clamps the ruffled and marked border assembly web in place. Once safety switches are activated, the knife blade travels the full distance across the material and returns to a home position. Once the knife has stopped, the clamp opens and the material or border assembly piece 246 may be removed.

Referring to FIG. 11, at the third sewing station or module 188, the operator then takes the ruffled, marked and cut to length border assembly piece 246 as shown in FIG. 14. The operator then folds the border assembly piece 246 with the tick sides facing each other and aligns the ends using the marks 290. The unticked side 247 of the ruffled, marked and cut to length border assembly piece 246 now faces out as shown in FIG. 11. The operator matches up the marks 290 and sews the two ends of the border assembly piece 246 together to create a border assembly loop 248. Any excess material may be trimmed. If a mitered corner is needed the operator will find the corner mark and fold the material on the mark and sew/trim the material off using one of the miter guide lines on the sewing head.

Referring to FIG. 12, at the fourth sewing station or module 200, the operator then takes the border assembly loop 248 which is turned inside out so now the unticked side 249 of the border assembly loop 248 is exposed. A roll 214 containing a second web of flange material 216 is put on roll holder 212 as shown in FIGS. 4 and 12. The second web of flange material 216 passes over bar 218 and is passed through flange folder 220 and inserted between the border assembly loop 248 and a generally rectangular piece of non-skid decking 250. The border assembly loop 248 is suspended by loop holder 222 (see FIG. 4) and the sewing machine 204.

Figure 18:
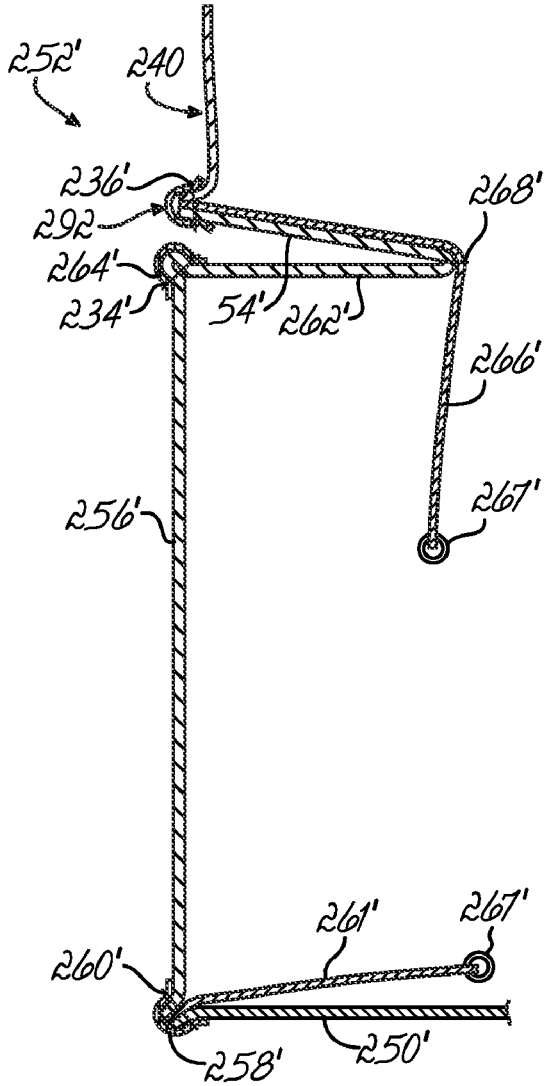
FIG. 18 is a schematic view of a box top mattress made on they system of the present invention.

The operator will match the corner of the non-skid decking 250 with a corner mark 288 on the border assembly loop 248, more particularly on the unticked side 229 of the web of border material 56. Then the sewing machine 204 sews the non-skid decking 250 to the border assembly loop 248 and second web of flange material 216 with a web of tape 282 in binder 282 to tape edge 258. See FIGS. 12 and 18. The border assembly loop 248 is sewn around completely. The web of tape 282 is then cut and sewed back over. If the corners are mitered, the border is turned inside out. The corners are aligned and the backing is attached to the border then turned right side out.

Figure 16:
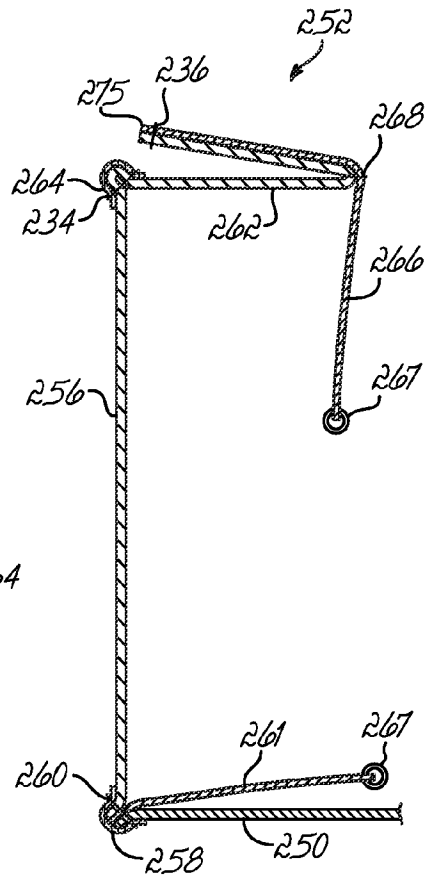
FIG. 16 is a cross-section taken along the line 16-16 of FIG. 15.
Figure 15:
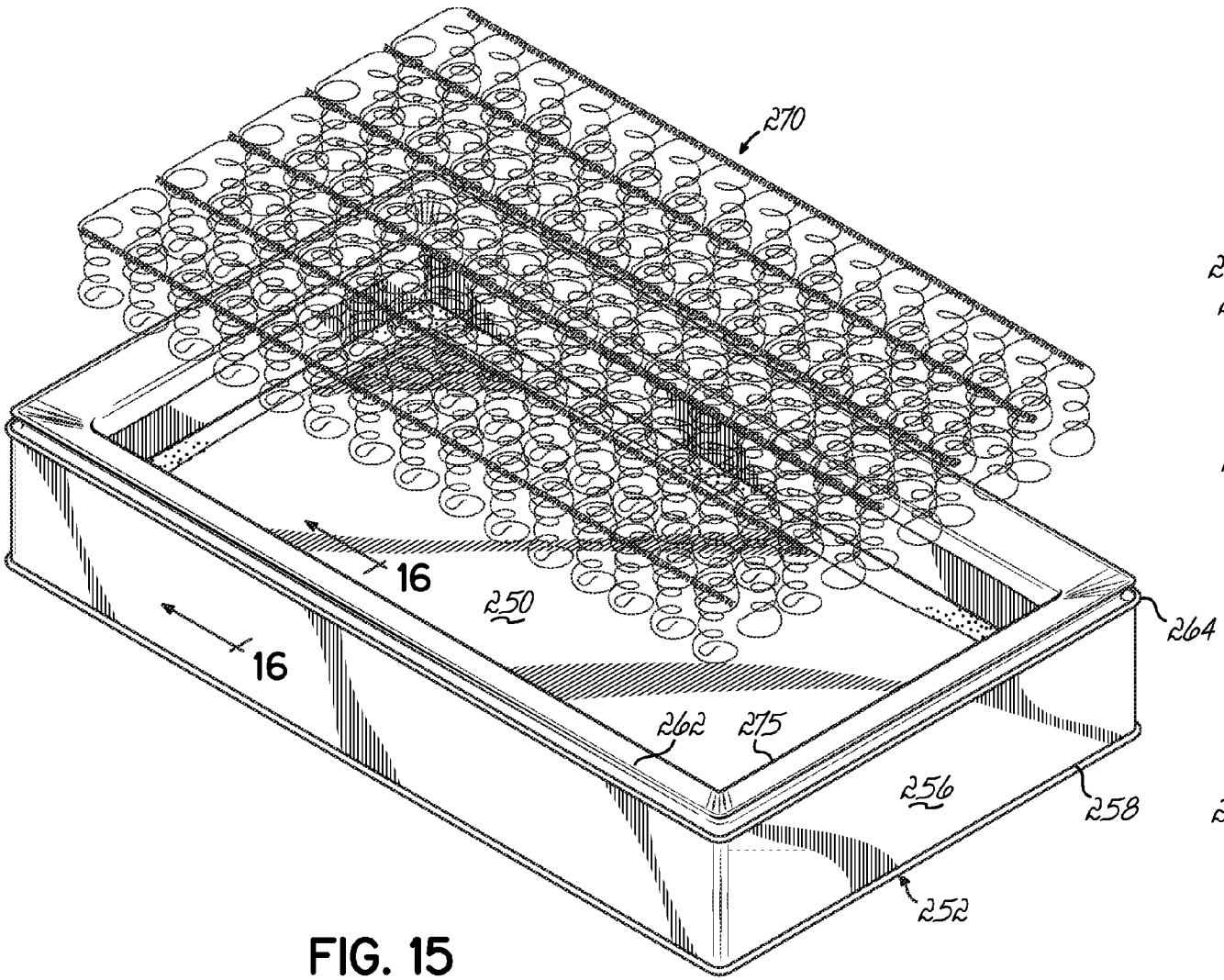
FIG. 15 is a perspective view of a spring core being inserted into the interior of a casing built in accordance with this invention.

FIGS. 15 and 16 show a casing or bucket 252 made in accordance with the method described above on the system described above. The casing 252 comprises a bottom panel 250 made from non-skid material joined to a border or side panel 256 made from the web of border material 56 with a tape edge 258 around the perimeter of casing 252 sewn with fourth seam 260. See FIG. 16. The fourth seam 260 also secures a lower flange 261 inside the casing 252 made from the second web of flange material 216. The casing 252 further comprises a gusset 262 made from the web of gusset material 54 sewn to the top edge of the border panel 256 made from the web of border material 56 with first seam 234 and including an upper tape edge 264. A second seam 236 joins the upper edge of the gusset 262 to an upper flange 266 made from the first web of flange material 100. Third seam 268 further joins the upper flange 266 to the bend or mid-point of the gusset 262.

As shown in FIG. 15 after the casing 252 is completed, a spring core 270 is inserted into the interior of casing 252. Although one type of spring core 270 is illustrated any other spring core may be used. Alternatively, a core having no springs, such as a foam core may be inserted into the interior of casing 252. The upper and lower flanges 266, 261 are secured to the spring core 270 with hog rings 267 or any other suitable way to prevent movement of the casing 252 relative to the spring core 270. As shown in FIG. 17, once the spring core 270 is secured to the flanges 266, 261, suitable layers of padding 272, such as foam or fiber, for example are placed over the spring core 270. Lastly, a tape edge machine (not shown) is used to secure cover 274 to the upper edge 275 of the gusset 262 as shown in FIGS. 16 and 17 to complete a mattress 300.

Figure 20:
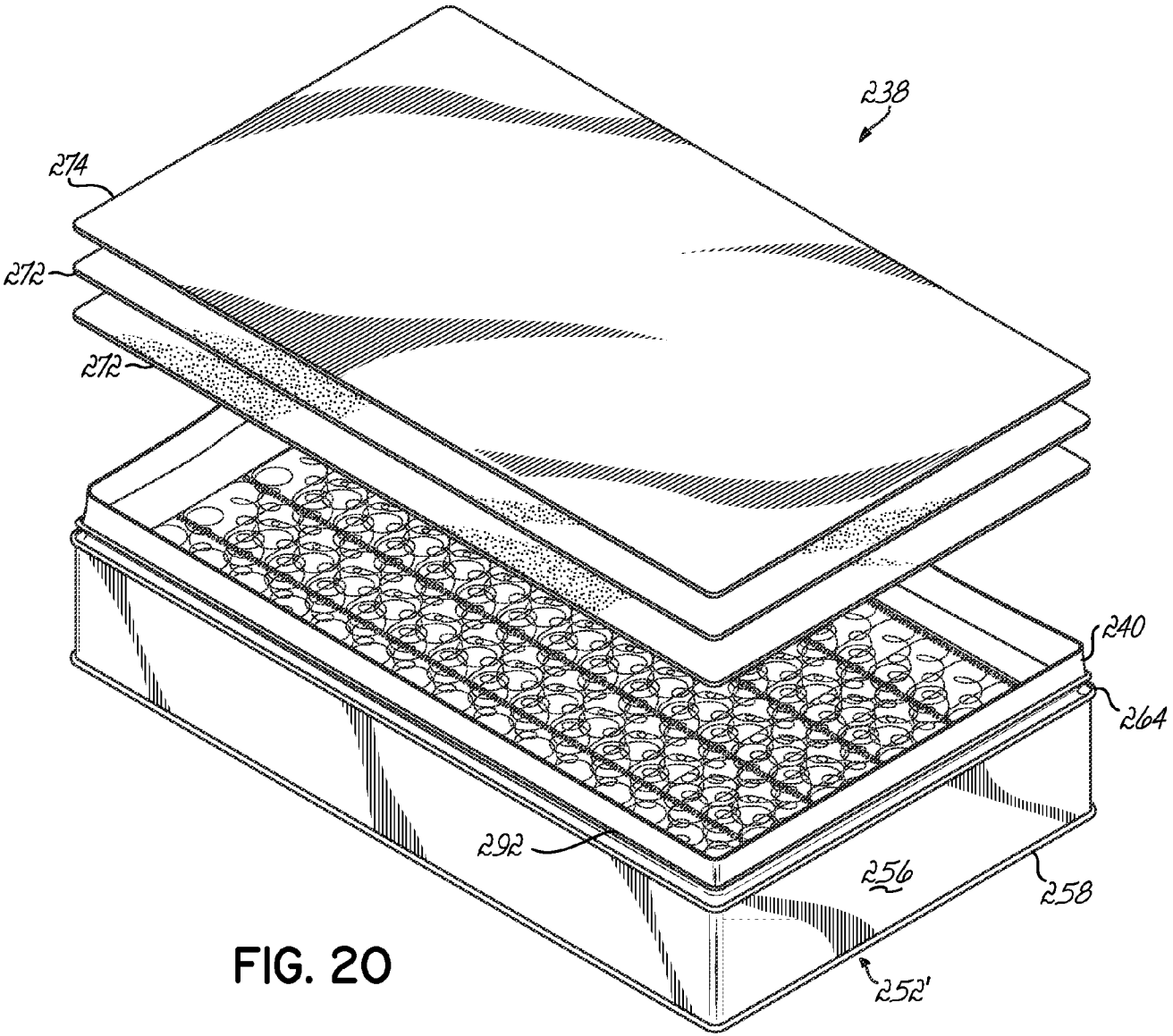
FIG. 20 is a partially disassembled view of a box top mattress made on they system of the present invention.

According to an alternative embodiment, a box top mattress 238 shown in FIG. 20 may be manufactured. For the sake of simplicity, the same numbers will be used in reference to FIGS. 18-20 for the same parts as described above with regards to a non-box top mattress 300 but with a prime after the number. In the process of making box top mattress 238, a web of box top border material 240 is rolled up into a roll, the roll being held by roll holder 242 (see FIG. 1). If such a mattress is desired, the second sewing machine 18, while making the second seam 236 (see FIG. 9B) also attaches the web of box top border 240 to the exposed edge of the web of gusset material 54. See FIG. 19. As seen in FIG. 19, a web of tape 244 unwound from a tape roll holder is used in making the second seam 236. The result is an upper tape edge 292 which extends the perimeter of the box top mattress 238 as seen in FIG. 20.

If making a box top mattress 238, opener 113 at the downstream end of the second sewing table 20 separates the web of box top border material 240 from the web of gusset material 54 so the unruffled border assembly 120' is in open position shown in FIG. 19.

While we have described only several embodiments of this invention, persons skilled in this art will appreciate that slightly different systems or machines may be utilized in the practice of this invention. Therefore, we do not intend to be limited except by the scope of the following appended claims.

We claim:

1. A method of manufacturing a casing for use in the manufacture of a bedding or seating product, said method comprising:

sewing a web of border material to a web of gusset material along a first seam;

sewing a first web of flange material to the web of gusset material along a second seam, the first web of flange material overlaying the web of gusset material while said second seam is being sewn;

sewing the first web of flange material and the web of gusset material along a longitudinally extending third seam spaced inwardly from the second seam;

ruffling the webs of flange and gusset material at predetermined positions to complete a border assembly web;

cutting the border assembly web to a predetermined length to create a border assembly piece;

sewing the ends of the border assembly piece together to create a border assembly loop;

inserting a second web of flange material between the border assembly loop and the bottom panel; and sewing a bottom panel to the border assembly loop.

2. The method of claim 1 wherein said first and second seams are sewn at a first sewing station.

3. The method of claim 1 further comprising applying tape over aligned edges of said webs of border and gusset material prior to sewing the first seam.

4. The method of claim 1 further comprising placing said web of gusset material on top of said web of border material, unticked sides of the webs facing each other, prior to sewing the first seam.

5. The method of claim 1 further comprising applying tape over aligned edges of said border assembly loop and bottom panel prior to sewing the bottom panel to the border assembly loop.

6. The method of claim 5 wherein each of said webs of flange material is folded by a folder prior to being sewn.

7. A method of manufacturing a casing for use in the manufacture of a bedding or seating product, said method comprising:

sewing a web of border material to a web of gusset material along a first seam at a first sewing station;

sewing a first web of flange material to the web of gusset material along a second seam at the first sewing station, the first web of flange material overlaying the web of gusset material while said second seam is being sewn;

sewing the first web of flange material and the web of gusset material along a longitudinally extending third seam spaced inwardly from the second seam;

ruffling the webs of flange and gusset material at predetermined positions to complete a border assembly web;

cutting the border assembly web to a predetermined length to create a border assembly piece;

sewing the ends of the border assembly piece together to create a border assembly loop; and sewing a bottom panel to the border assembly loop wherein said third seam is sewn at a second sewing station remote from the first sewing station.

8. The method of claim 7 wherein the ends of the border assembly piece are sewn together at a third sewing station remote from the first and second sewing stations.

9. The method of claim 8 wherein a bottom panel is sewn to the border assembly loop at a fourth sewing station remote from the first, second and third sewing stations.

10. A method of manufacturing a casing for use in the manufacture of a bedding or seating product, said method comprising:

sewing a web of border material to a web of gusset material along a first seam;

sewing a first web of flange material to the web of gusset material along a second seam, the first web of flange material overlaying the web of gusset material while said second seam is being sewn;

sewing the first web of flange material and the web of gusset material along a longitudinally extending third seam spaced inwardly from the second seam;

ruffling the webs of flange and gusset material at predetermined positions to complete a border assembly web;

cutting the border assembly web to a predetermined length to create a border assembly piece;

sewing the ends of the border assembly piece together to create a border assembly loop; and sewing a bottom panel to the border assembly loop wherein the first seam is sewn at a first sewing machine and the second seam is sewn at a second sewing machine.

11. The method of claim 10 wherein the third seam is sewn at a third sewing machine, the third sewing machine having a ruffler.

12. A method of manufacturing a casing for use in the manufacture of a bedding or seating product, said method comprising:

sewing a web of border material to a web of gusset material along a first seam;

sewing a first web of flange material to the web of gusset material along a second seam, the first web of flange material overlaying the web of gusset material while said second seam is being sewn;

sewing the first web of flange material and the web of gusset material along a longitudinally extending third seam spaced inwardly from the second seam;

ruffling the webs of flange and gusset material at predetermined positions to complete a border assembly web;

cutting the border assembly web to a predetermined length to create a border assembly piece;

sewing the ends of the border assembly piece together to create a border assembly loop;

sewing a bottom panel to the border assembly loop; and marking the web of border material at predetermined locations to aid in sewing the bottom panel to the border assembly loop.

13. A method of manufacturing a casing for use in the manufacture of a bedding or seating product, said method comprising:

sewing a web of border material to a web of gusset material along a first seam;

sewing a first web of flange material to the web of gusset material along a second seam, the first web of flange material overlaying the web of gusset material while said second seam is being sewn;

sewing the first web of flange material and the web of gusset material along a longitudinally extending third seam spaced inwardly from the second seam;

ruffling the webs of flange and gusset material at predetermined positions by providing an encoder to complete a border assembly web;

cutting the border assembly web to a predetermined length to create a border assembly piece;

sewing the ends of the border assembly piece together to create a border assembly loop;

sewing a bottom panel to the border assembly loop.

14. A method of manufacturing a casing for use in the manufacture of a bedding or seating product, said method comprising:

sewing a web of border material to a web of gusset material along a first seam;

sewing a first web of flange material to the web of gusset material along a second seam, the first web of flange material overlaying the web of gusset material while said second seam is being sewn;

sewing the first web of flange material and the web of gusset material along a longitudinally extending third seam spaced inwardly from the second seam;

ruffling the webs of flange and gusset material at predetermined positions to complete a border assembly web;

cutting the border assembly web to predetermined length by providing an encoder to create a border assembly piece;

sewing the ends of the border assembly piece together to create a border assembly loop;

sewing a bottom panel to the border assembly loop.

15. A method of manufacturing a casing for use in the manufacture of a bedding or seating product, said method comprising:

sewing a web of border material to a web of gusset material along a first seam at a first sewing station;

sewing a first web of flange material to the web of gusset material along a second seam at the first sewing station, the first web of flange material overlaying the web of gusset material while said second seam is being sewn;

sewing the first web of flange material and the web of gusset material along a longitudinally extending third seam spaced inwardly from the second seam at a second sewing station remote from the first sewing station;

ruffling the webs of flange and gusset material at predetermined positions to complete a border assembly web by providing an encoder;

cutting the border assembly web to a predetermined length to create a border assembly piece;

sewing the ends of the border assembly piece together to create a border assembly loop; and sewing a bottom panel to the border assembly loop wherein sewing said third seam occurs at a second sewing station remote from the first sewing station.

16. A method of manufacturing a casing for use in the manufacture of a mattress, said method comprising:

at a first sewing station:

sewing a first web of border material to a web of gusset material along a first seam using a first sewing head;

sewing a first web of flange material to the web of gusset material along a second seam using a second sewing head downstream of the first sewing head, the web of flange material overlaying the web of gusset material;

at a second sewing station remote from the first sewing station:

sewing the webs of flange and gusset material along a longitudinally extending third seam spaced inwardly from the second seam using a third sewing head;

ruffling the webs of flange and gusset material at predetermined positions to complete a border assembly web;

cutting the border assembly web to a predetermined length to create a border assembly piece;

at a third sewing station remote from the first and second sewing stations:

sewing the ends of the border assembly piece together along a fourth seam to create a border assembly loop using a fourth sewing head; and at a fourth sewing station remote from the first and second sewing stations:

sewing a bottom panel to the border assembly loop along a fifth seam using a fifth sewing head.

17. The method of claim 16 further comprising inserting a second web of flange material between the border assembly loop and the bottom panel.

18. The method of claim 17 further comprising applying tape over aligned edges of said border assembly loop and bottom panel prior to sewing the fifth seam.

19. The method of claim 16 further comprising placing said web of gusset material on top of said web of border material, the unticked sides of the webs facing each other, prior to sewing the first seam.

20. A method of manufacturing a bedding or seating product, said method comprising:

sewing a web of border material to a web of gusset material proximate aligned edges of the webs;

sewing a first web of flange material to the web of gusset material along an edge of the gusset material oppose the edge of the gusset material joined to the border material to create a three piece web, the web of flange material overlaying the web of gusset material;

sewing the webs of flange and gusset material along a longitudinally extending seam spaced inwardly from the sewn edges of the webs of flange and gusset material, said sewing including ruffling the webs of flange and gusset material at predetermined positions to complete a border assembly web;

cutting the border assembly web to a predetermined length to create a border assembly piece;

sewing the ends of the border assembly piece together to create a border assembly loop;

sewing a bottom panel to the border assembly loop to complete a casing;

inserting a spring core into the casing;

laying padding materials over the spring core;

sewing a top panel to an outer edge of the gusset material of the casing; and inserting a second web of flange material between the border assembly loop and the bottom panel prior to sewing the bottom panel to the border assembly loop.

21. The method of claim 20 further comprising securing said spring core to said flange material.

22. The method of claim 20 wherein said webs of border and gusset material are supplied by rolls prior to being sewn together.

23. The method of claim 20 further comprising applying tape over aligned edges of said webs of border and gusset material prior to sewing them together.

24. The method of claim 20 further comprising placing said web of gusset material on top of said web of border material, unticked sides of the webs facing each other, prior to sewing them together.

25. The method of claim 20 further comprising marking the web of border material at predetermined locations to aid in sewing the bottom panel to the border loop.

26. The method of claim 20 further comprising ruffling the webs of flange and gusset material at predetermined locations with the assistance of an encoder.

27. The method of claim 20 further comprising creating a border piece of a predetermined length with the assistance of an encoder.

* * * * *